US011987968B2

(12) United States Patent
Hashimoto et al.

(10) Patent No.: US 11,987,968 B2
(45) Date of Patent: May 21, 2024

(54) FLUSH TOILET DEVICE

(71) Applicant: TOTO LTD., Kitakyushu (JP)

(72) Inventors: Hiroshi Hashimoto, Kitakyushu (JP); Kenichi Nakamura, Kitakyushu (JP); Takumi Tsuchitani, Kitakyushu (JP); Shinichi Urata, Kitakyushu (JP); Chisato Sone, Kitakyushu (JP); Koichiro Matsumura, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 50 days.

(21) Appl. No.: 17/822,650

(22) Filed: Aug. 26, 2022

(65) Prior Publication Data

US 2023/0066417 A1 Mar. 2, 2023

(30) Foreign Application Priority Data

Aug. 27, 2021 (JP) ..... 2021-139355
Aug. 27, 2021 (JP) ..... 2021-139356
(Continued)

(51) Int. Cl.
*E03D 11/08* (2006.01)
*E03D 1/34* (2006.01)
*E03D 1/38* (2006.01)

(52) U.S. Cl.
CPC ..... *E03D 11/08* (2013.01); *E03D 1/34* (2013.01); *E03D 1/38* (2013.01); *E03D 2201/40* (2013.01)

(58) Field of Classification Search
CPC .... E03D 1/34; E03D 1/35; E03D 1/36; E03D 1/38; E03D 3/02; E03D 11/08; E03D 2201/40
(Continued)

(56) References Cited

U.S. PATENT DOCUMENTS 5,204,999 A * 4/1993 Makita ..... E03D 5/10 4/425
8,418,277 B2 * 4/2013 Okubo ..... E03D 5/10 4/431
(Continued)

FOREIGN PATENT DOCUMENTS

JP H06-146365 A 5/1994
JP H08-277567 A 10/1996
(Continued)

OTHER PUBLICATIONS

"Decision to Grant a Patent" Office Action issued in JP 2022-059287; mailed by the Japanese Patent Office on Aug. 7, 2023.
(Continued)

*Primary Examiner* — Tuan N Nguyen
(74) *Attorney, Agent, or Firm* — Studebaker & Brackett PC

(57) ABSTRACT

The present invention provides a flush toilet device (1) including: a flush toilet (2); a flush water tank (10); a discharge valve (12) that discharges the flush water stored in the flush water tank; a branching portion (33) that splits flush water supplied from a water supply source into first and second branched flow paths; a first on-off valve (19) provided in the first branched flow path and switches between spout and stop of the flush water from the upper spout port; a second on-off valve (17) provided in the second branched flow path and switches between supply and stop of the flush water into the flush water tank; and a controller (28) that controls the first and second on-off valve so that water is spouted from the upper spout port and is supplied into the flush water tank at a time by opening the first and second on-off valves.

6 Claims, 8 Drawing Sheets

(30) Foreign Application Priority Data

Aug. 27, 2021 (JP) ..... 2021-139357
Mar. 31, 2022 (JP) ..... 2022-059287

(58) Field of Classification Search
USPC .... 4/374, 378, 379, 388, 405, 420, 422, 425
See application file for complete search history.

(56) References Cited

U.S. PATENT DOCUMENTS

| | | | | |
|---|---|---|---|---|
| 11,505,933 | B2 | 11/2022 | Kitaura et al. | |
| 2021/0040718 | A1* | 2/2021 | Kitaura | E03D 1/34 |

FOREIGN PATENT DOCUMENTS

| | | | |
|---|---|---|---|
| JP | 2002-061252 | A | 2/2002 |
| JP | 2008-57238 | A | 3/2008 |
| JP | 2015-068078 | A | 4/2015 |

OTHER PUBLICATIONS

An Office Action issued by the United States Patent and Trademark Office on Jan. 31, 2024, in U.S. Appl. No. 17/822,650 which is related to U.S. Appl. No. 17/822,650.

* cited by examiner

FLUSH TOILET DEVICE

BACKGROUND OF THE INVENTION

Field of the Invention

The present invention relates to a flush toilet device, and more particularly to a flush toilet device that supplies flush water to an upper spout port provided above a pooled water surface of a flush toilet main body and a lower spout port provided below the pooled water surface to perform a flush.

Description of the Related Art

A flush toilet is disclosed in Japanese Patent Laid-Open No. 2002-61252 (Patent Document 1). This flush toilet includes a low tank (flush water tank) in which flush water is stored, and the flush water stored in the low tank is spouted from a jet port of the flush toilet. On the other hand, rim flush water to be spouted to a rim of the flush toilet is spouted by a water supply pressure of a water supply pipe. In this way, a flush toilet of a type that supplies, from the flush water tank, a part of flush water for washing the flush toilet, and directly supplies the remainder of the flush water from a water supply source such as waterworks has advantages in that a volume of the flush water tank can be reduced, an instantaneous flow rate of the flush water to be supplied can be increased, and the like.

In the flush toilet described as the second embodiment of Patent Document 1, flush water is spouted from the jet port in the midst of continuing the supply of rim flush water. That is, the rim flush water is supplied from before and to after spouting the water from the jet port. There is an advantage in that such a flush pattern can suppress a shortage of sealing water in a discharge trap conduit of the flush toilet during a toilet flush.

However, in the flush toilet disclosed in Patent Document 1, the total amount of flush water directly supplied from the water supply source such as waterworks is spouted, as rim flush water, from a rim spout hole during a toilet flush, and therefore flush water is spouted, at an excess flow rate, from the rim spout hole, whereby the flush water is wasted. Since the water supply to the flush water tank is started after the termination of rim spout, a long time is required until a predetermined amount of flush water is stored in the flush water tank after one toilet flush is performed. Although the flush toilet directly uses flush water supplied from the water supply source, a long time is required until a next flush can be performed after one toilet flush is performed.

Accordingly, an object of the present invention is to provide a flush toilet device which makes it possible to suppress occurrence of wasteful water while using flush water stored in a flush water tank and flush water supplied from a water supply source for a toilet flush.

SUMMARY OF THE INVENTION

In order to solve the above-described problems, the present invention provides a flush toilet device that supplies flush water to an upper spout port provided above a pooled water surface of a flush toilet main body and a lower spout port provided below the pooled water surface to perform a flush, the flush toilet device comprising: a flush toilet main body that includes a bowl and a discharge trap conduit communicating with a lower portion of the bowl; a flush water tank main body that stores flush water for washing the flush toilet main body; a discharge valve that switches between spout and stop of the flush water from the lower spout port by switching between discharge and stop of the flush water stored in the flush water tank main body; a branching portion that splits flush water supplied from a water supply source into a first branched flow path and a second branched flow path; a first on-off valve that is provided in the first branched flow path and switches between a spouting state and a spouting stop state of the flush water from the upper spout port; a second on-off valve that is provided in the second branched flow path and switches between supply and stop of the flush water into the flush water tank main body; and a controller that controls the first on-off valve and the second on-off valve so that water is spouted from the upper spout port and is supplied into the flush water tank main body at a time by opening the first on-off valve and the second on-off valve.

In the present invention thus constituted, the discharge valve is used to switch between discharge and stop of the flush water stored in the flush water tank main body and to switch between spout and stop of the flush water from the lower spout port of the flush toilet main body. On the other hand, the flush water supplied from the water supply source is split into the first branched flow path and the second branched flow path from the branching portion. The first on-off valve is provided in the first branched flow path to switch between the spouting state and the spouting stop state of the flush water from the upper spout port, and the second on-off valve is provided in the second branched flow path to switch between the supply and the stop of the flush water into the flush water tank main body. The controller controls the first on-off valve and the second on-off valve so that the water is spouted from the upper spout port and is supplied into the flush water tank main body at a time.

According to the present invention thus constituted, since the water is spouted from the upper spout port and is supplied into the flush water tank main body at a time, the water is supplied into the flush water tank main body while the water is spouted from the upper spout port to wash the flush toilet main body, which makes it possible to shorten the time until a next flush can be performed after one toilet flush is performed.

In the present invention, it is preferable that the second on-off valve is opened in a state that the first on-off valve is opened and the water is spouted from the upper spout port, and a flow rate of the flush water spouted from the upper spout port is reduced when the second on-off valve is opened.

In general, the water spout from the upper spout port serves a function of washing a bowl surface of the flush toilet main body and a function of suppressing lowering of the pooled water surface in the bowl to prolong the duration of a siphon action after the spout of the water from the lower spout port is started. Here, a relatively large flow rate is required to wash the bowl, whereas a flow rate sufficient to maintain sealing water in the discharge trap conduit is only required to prolong the siphon action, and therefore, a large flow rate is not required. According to the present invention constituted as described above, the flush water spouted from the upper spout port is reduced when the second on-off valve is opened and the water supply into the flush water tank main body is started, which makes it possible to supply the flush water of a sufficient amount required to prolong the siphon action and to suppress occurrence of wasteful water.

In the present invention, it is preferable that the controller causes the second on-off valve to be opened while the first on-off valve is maintained in the valve open state after the first on-off valve is opened. According to the present invention thus constituted, the spout of the flush water from the upper spout port and the water supply to the flush water tank can be controlled independently by the first on-off valve and the second on-off valve, respectively, whereby the water can be supplied to the flush water tank at an arbitrary timing while continuing the spout of the water from the upper spout port. This enables the water to be supplied to the flush water tank without inhibiting the toilet flush.

In the present invention, it is preferable that a hydraulic driving mechanism is further provided, which drives a discharge valve using a water supply pressure of the flush water supplied from the water supply source, and the hydraulic driving mechanism drives the discharge valve by supplying the flush water that has flowed out of the second on-off valve to the hydraulic driving mechanism.

According to the present invention thus constituted, the hydraulic driving mechanism drives the discharge valve when the flush water that has flowed out of the second on-off valve is supplied to the hydraulic driving mechanism, whereby the second on-off valve can be used to control the water supply to the flush water tank and the discharge valve, which makes it possible to simplify a configuration of the flush toilet device.

In the present invention, it is preferable that at least a part of the flush water supplied to the hydraulic driving mechanism flows into the flush water tank main body after the flush water actuates the hydraulic driving mechanism. According to the present invention thus constituted, the flush water that has flowed through the hydraulic driving mechanism flows into the flush water tank main body, whereby the flush water used for driving the discharge valve can be also used, without waste, for the next toilet flush, which makes it possible to enhance the use efficiency of the flush water.

In the present invention, it is preferable that after any one of the first on-off valve and the second on-off valve is closed, the other valve is maintained in a valve open state for a predetermined time period, and refill water is supplied to the flush toilet main body.

According to the present invention thus constituted, the timing of the opening and closing of each of the first on-off valve and the second on-off valve can be freely set, whereby the degree of flexibility in design of the supply of the refill water can be increased.

In the present invention, it is preferable that a part of the flush water that has flowed out of the hydraulic driving mechanism flows into the flush water tank main body, and the remainder of the flush water bypasses the discharge valve to flow into the flush toilet main body from the lower spout port.

According to the present invention thus constituted, a part of the flush water that has flowed out of the hydraulic driving mechanism flows into the flush water tank main body and the remainder flows into the flush toilet main body from the lower spout port, which makes it possible to appropriately distribute the flush water into the next flush and the refill and to use the supplied flush water efficiently.

According to the flash toilet device of the present invention, the occurrence of wasteful water can be suppressed while using the flush water stored in the flush water tank and the flush water supplied from the water supply source for a toilet flush.

DETAILED DESCRIPTION OF THE PREFERRED EMBODIMENTS

Next, a flush toilet device according to embodiments of the present invention will be described with reference to the accompanying drawings.

Figure 1:
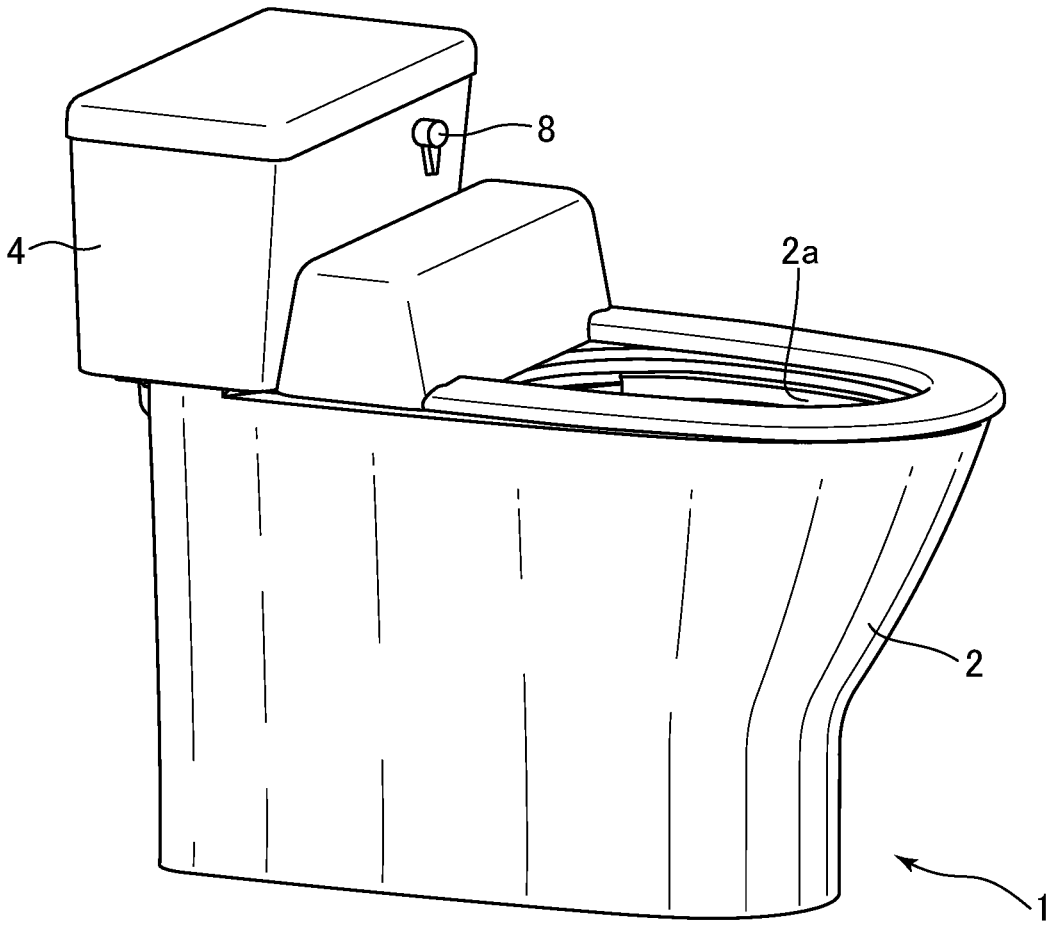
FIG. 1 is a perspective view illustrating the entire flush toilet device according to a first embodiment of the present invention.
Figure 2:
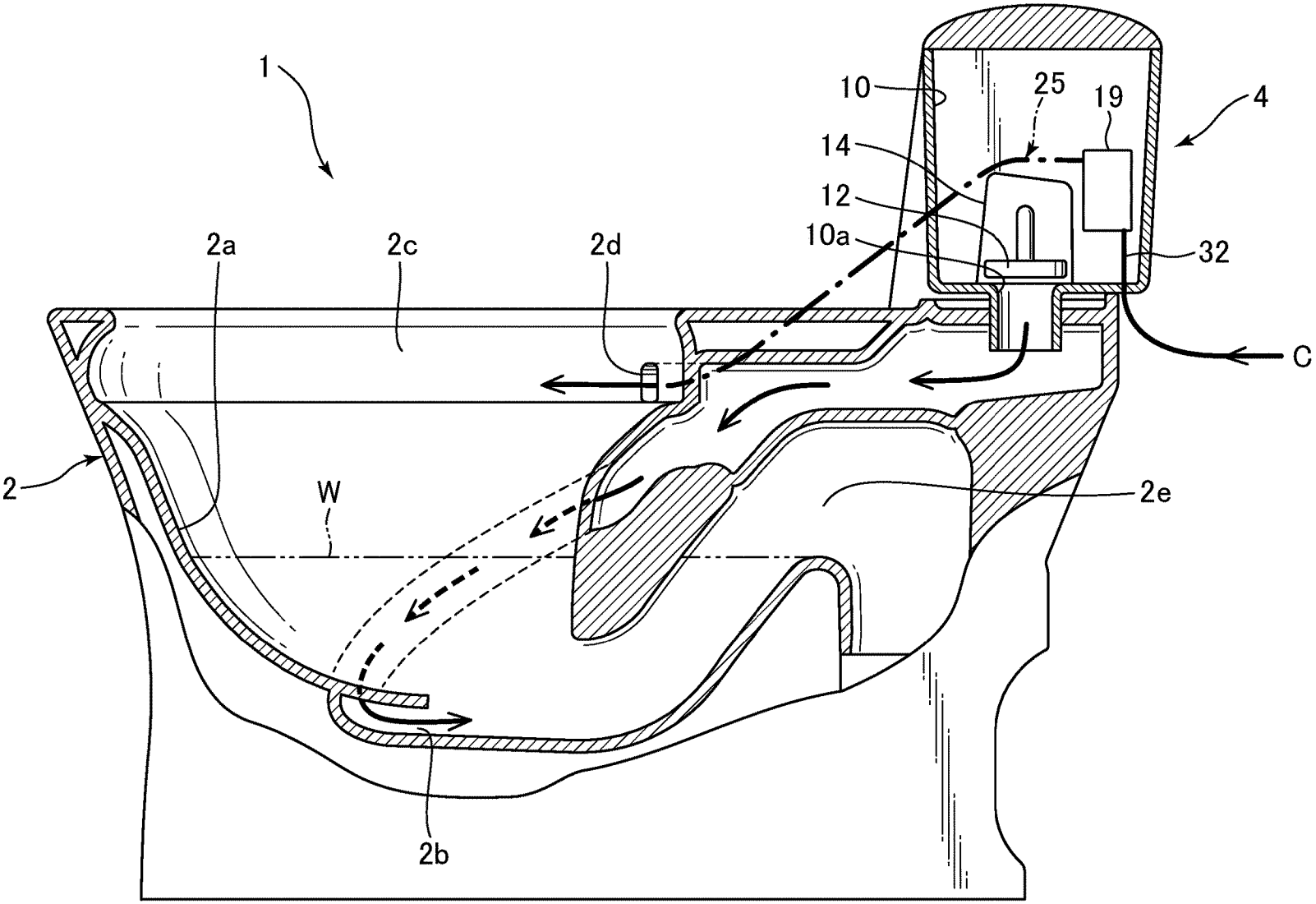
FIG. 2 is a total cross-sectional view of the flush toilet device according to the first embodiment of the present invention.
Figure 3:
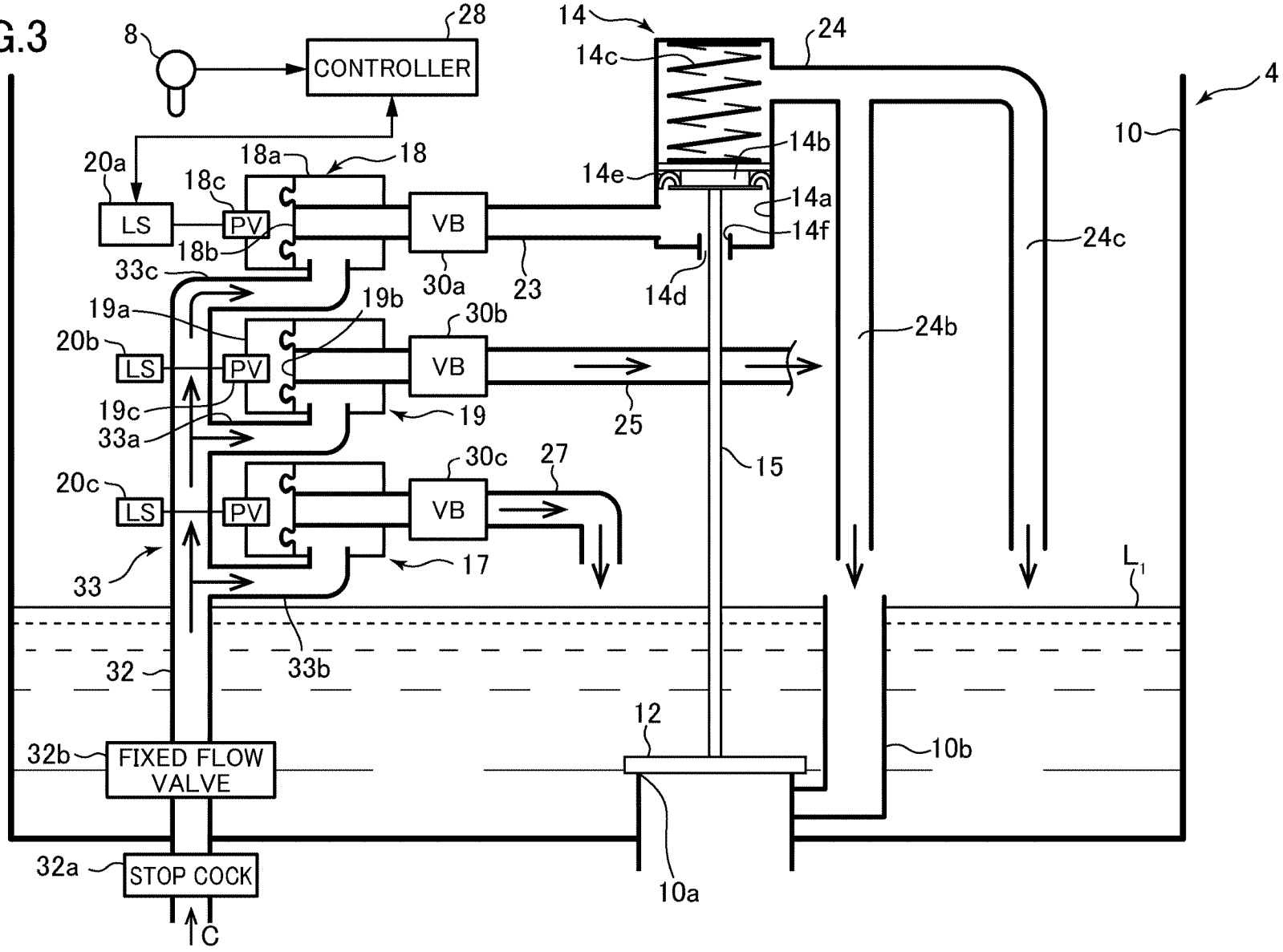
FIG. 3 is a cross-sectional view illustrating a schematic configuration of a flush water tank device included in the flush toilet device according to the first embodiment of the present invention.

FIG. 1 is a perspective view illustrating the entire flush toilet device according to a first embodiment of the present invention. FIG. 2 is a total cross-sectional view of the flush toilet device according to the first embodiment of the present invention. FIG. 3 is a cross-sectional view illustrating a schematic configuration of a flush water tank device included in the flush toilet device according to the first embodiment of the present invention.

As illustrated in FIGS. 1 and 2, a flush toilet device 1 according to the first embodiment of the present invention includes a flush toilet main body 2 and a flush water tank device 4 mounted at a rear portion thereof. The flush toilet device 1 of the present embodiment is configured to wash a bowl 2*a* of the flush toilet main body 2 when a lever handle 8 provided on the flush water tank device 4 is operated after use of the flush toilet device 1. The flush water tank device 4 according to the present embodiment is configured to supply, to the flush toilet main body 2, flush water stored in the flush water tank device 4 and flush water supplied from waterworks C serving as the water supply source in response to operation of the lever handle 8, and use the supplied flush water to wash the bowl 2*a*.

As a modified example, the present invention can be constituted so that the bowl 2*a* can be washed when a remote control device (not illustrated) attached to a wall surface is operated. Alternatively, the present invention can be also constituted so that the bowl 2*a* can be washed after a lapse of a predetermined time from when a human sensor (not illustrated) provided in a toilet seat detects that a user leaves the toilet seat. In this case, the human sensor (not illustrated) may be provided to the toilet seat or at a position enabling detection of a user's action of sitting on or leaving the toilet seat, or approaching, detaching from, or bringing a hand close to the flush toilet device 1, and therefore, may be provided to the flush toilet main body 2 or the flush water tank device 4, for example. The human sensor (not illustrated) may be any sensor that can detect a user's action of sitting on or leaving the toilet seat, or approaching, detaching from, or bringing a hand close to the flush toilet device 1, and therefore, for example, an infrared ray sensor or a microwave sensor may be used as the human sensor.

Next, as illustrated in FIG. 2, the flush water tank device 4 includes a storage tank 10 serving as the flush water tank main body that stores flush water to be supplied to the flush toilet main body 2, a discharge valve 12 for opening and closing a discharge port 10*a* provided in the storage tank 10, and a discharge valve hydraulic driving part 14 serving as the hydraulic driving mechanism that drives the discharge valve 12. Furthermore, the flush water tank device 4 includes a spout control valve 19 serving as the first on-off valve that directly supplies, to the flush toilet main body 2, the flush water supplied from the waterworks C. Here, the flush water tank device 4 is configured so that the flush water stored in the storage tank 10 and flowing out of the storage tank 10 when the discharge valve 12 is opened is spouted, during a toilet flush, from a jet spout port 2*b* serving as the lower spout port provided below a pooled water surface W of the bowl 2*a* of the flush toilet main body 2. In addition, the flush water tank device 4 is configured so that the flush water supplied from the waterworks C via the spout control valve 19 is spouted, during a toilet flush, from a rim spout port 2*d* serving as the upper spout port provided in a rim 2*c* of the bowl 2*a* and above the pooled water surface W of the bowl 2*a*. Furthermore, a discharge trap conduit 2*e* communicates with a lower portion of the bowl 2*a*, and an inlet of the discharge trap conduit 2*e* is directed to face the jet spout port 2*b*.

Next, as illustrated in FIG. 3, the flush water tank device 4 includes a water supply control valve 17 serving as the second on-off valve that switches between supply and stop of the flush water into the storage tank 10, a discharge valve control valve 18 that controls water supply to the discharge valve hydraulic driving part 14, and the spout control valve 19 that controls spout and stop of the flush water from the rim spout port 2*d*. Furthermore, the flush water tank device 4 includes a controller 28 serving as the controller, and the controller 28 controls the water supply control valve 17, the discharge valve control valve 18, and the spout control valve 19.

The storage tank 10 is a tank configured to store the flush water to be supplied to the jet spout port 2*b* of the flush toilet main body 2, and the discharge port 10*a* for discharging the stored flush water into the flush toilet main body 2 is formed in a bottom portion of the storage tank 10. In the storage tank 10, an overflow pipe 10*b* is connected to a downstream side of the discharge port 10*a*. The overflow pipe 10*b* rises vertically from near the discharge port 10*a* and extends above a stopped water level $L_1$ of the flush water stored in the storage tank 10. Accordingly, the flush water that has flowed in from an upper end of the overflow pipe 10*b* bypasses the discharge port 10*a* to directly flow out of the jet spout port 2*b* of the flush toilet main body 2.

The discharge valve 12 is a valve body placed to open and close the discharge port 10*a*, and is opened when the discharge valve 12 is pulled up upward, whereby the flush water in the storage tank 10 is drained into the flush toilet main body 2 and is spouted from the jet spout port 2*b* provided in the lower portion of the bowl 2*a*.

On the other hand, the flush water supplied from the waterworks C to a water supply pipe 32 flows into a water supply pipe branching portion 33 serving as the branching portion, via a stop cock 32*a* and a fixed flow valve 32*b*. The flush water supplied from the waterworks C is split from the water supply pipe branching portion 33 into a first branched pipe 33*a* serving as the first branched flow path, a second branched pipe 33*b* serving as the second branched flow path, and a third branched pipe 33*c*. In addition, the spout control valve 19 is provided in the first branched pipe 33*a*, the water supply control valve 17 is provided in the second branched pipe 33*b*, and the discharge valve control valve 18 is provided in the third branched pipe 33*c*. Note that the stop cock 32*a* is placed outside the storage tank 10, and, on the downstream side thereof, is connected to the fixed flow valve 32*b* in the storage tank 10, and the water supply pipe branching portion 33 is provided on the downstream side of the fixed flow valve 32*b*.

The stop cock 32*a* is provided to stop the water supply to the flush water tank device 4 at the time of maintenance or the like, and is normally used in an open state. The fixed flow valve 32*b* is provided to cause the water supplied from the waterworks C to flow into the water supply pipe branching portion 33 at a predetermined flow rate, and is configured to supply the water to the flush water tank device 4 at a constant flow rate regardless of placement environment of the flush toilet device 1.

On the other hand, the spout control valve 19 provided in the first branched pipe 33*a* is configured to cause the water supplied from the first branched pipe 33*a* to flow out to the rim water supply pipe 25. The rim water supply pipe 25 communicates with the rim spout port 2*d* of the flush toilet main body 2 (not illustrated in FIG. 3), and spouts, from the rim spout port 2*d*, the flush water that has flowed into the rim water supply pipe 25, as rim flush water for washing the bowl 2*a*. A vacuum breaker 30*b* is provided in the middle of the rim water supply pipe 25. This can prevent the water from flowing backward from a side of the flush toilet main body 2 to the spout control valve 19 when the spout control valve 19 side is brought into a negative pressure.

The spout control valve 19 includes a spout valve main body 19*a*, a main valve body 19*b* placed in the spout valve main body 19*a*, and an electromagnetic valve pilot valve 19*c*. An electromagnetic valve 20*b* for spout control is connected to the spout control valve 19 so that the electromagnetic valve pilot valve 19*c* is moved by the electromagnetic valve 20*b* for spout control. That is, the electromagnetic valve pilot valve 19*c* is configured to open and close a pilot valve port (not illustrated) provided in the spout valve main body 19*a*. When the pilot valve port (not illustrated) is opened, the pressure inside a pressure chamber provided in the spout valve main body 19*a* decreases, and the main valve body 19*b* of the spout control valve 19 is opened. In addition, when the pilot valve port (not illustrated) is closed, the pressure inside the pressure chamber increases, and the main valve body 19*b* is closed. Accordingly, the main valve body 19*b* of the spout control valve 19 is opened and closed in response to the operation of the electromagnetic valve 20*b* for spout control to thereby control supply and stop of the water to the rim spout port 2*d*.

The water supply control valve 17 provided in the second branched pipe 33*b* is configured to cause the water supplied from the second branched pipe 33*b* to flow out to the tank water supply pipe 27. The tank water supply pipe 27 is configured to supply the flush water into the storage tank 10, and the flush water that has flowed into the tank water supply pipe 27 is drained into and stored in the storage tank 10. A vacuum breaker 30*c* is provided in the middle of the tank water supply pipe 27. This can prevent the water from flowing backward from a side of the storage tank 10 to the water supply control valve 17 when the water supply control valve 17 side is brought into a negative pressure.

The water supply control valve 17 includes a water supply valve main body 17*a*, a main valve body 17*b* placed in the water supply valve main body 17*a*, and an electromagnetic valve pilot valve 17*c*. An electromagnetic valve 20*c* for water supply control is connected to the water supply control valve 17 so that the electromagnetic valve pilot valve 17*c* is moved by the electromagnetic valve 20*c* for water supply control. That is, the electromagnetic valve pilot valve 17*c* is configured to open and close a pilot valve port (not illustrated) provided in the water supply valve main body 17*a*. When the pilot valve port (not illustrated) is opened, the pressure inside a pressure chamber provided in the water supply valve main body 17*a* decreases, and the main valve body 17*b* of the water supply control valve 17 is opened. In addition, when the pilot valve port (not illustrated) is closed, the pressure inside the pressure chamber increases, and the main valve body 17*b* is closed. Accordingly, the main valve body 17*b* of the water supply control valve 17 is opened and closed in response to the operation of the electromagnetic valve 20*c* for water supply control to thereby control supply and stop of the water into the storage tank 10.

Next, the discharge valve control valve 18 provided in the third branched pipe 33*c* is configured to cause the water supplied from the third branched pipe 33*c* to flow out to the discharge valve hydraulic driving part 14. The discharge valve control valve 18 includes a control valve main body 18*a*, a main valve body 18*b* placed in the control valve main body 18*a*, and an electromagnetic valve pilot valve 18*c*. Furthermore, an electromagnetic valve 20*a* for discharge control is connected to the discharge valve control valve 18.

The electromagnetic valve 20*a* for discharge control is configured to move the electromagnetic valve pilot valve 18*c* incorporated in the discharge valve control valve 18 to open and close a pilot valve port (not illustrated) on the basis of a signal transmitted from the controller 28. When the pilot valve port (not illustrated) is opened, the pressure inside a pressure chamber provided in the control valve main body 18*a* decreases, and the main valve body 18*b* of the discharge valve control valve 18 is opened. In addition, when the pilot valve port (not illustrated) is closed, the pressure inside the pressure chamber increases, and the main valve body 18*b* is closed. Accordingly, the main valve body 18*b* of the discharge valve control valve 18 is opened and closed in response to the operation of the electromagnetic valve 20*a* for discharge control to thereby control supply and stop of the water to the discharge valve hydraulic driving part 14. Note that in the present embodiment, as the electromagnetic valve 20*a* for discharge control, there is used a bistable latching solenoid that moves the electromagnetic valve pilot valve 18*c* when the energization is performed once, and maintains this state even when the energization is stopped. This type of electromagnetic valve can return the electromagnetic valve pilot valve 18*c* to an original position when the energization is performed again in the opposite direction.

Next, the discharge valve hydraulic driving part 14 is configured to drive the discharge valve 12 using the water supply pressure of the flush water supplied from the waterworks C. That is, the discharge valve control valve 18 controls supply and stop of the supplied flush water to the discharge valve hydraulic driving part 14 on the basis of an instruction signal from the controller 28 serving as the controller. In the present embodiment, the total amount of the flush water that has flowed out of the discharge valve control valve 18 is supplied to the discharge valve hydraulic driving part 14 through an inflow pipe 23.

A vacuum breaker 30*a* is provided in the inflow pipe 23 that connects the discharge valve control valve 18 and the discharge valve hydraulic driving part 14. If the discharge valve control valve 18 side is brought into a negative pressure by this vacuum breaker 30*a*, outside air is drawn into the inflow pipe 23, which can prevent the water from flowing backward from the discharge valve hydraulic driving part 14 side.

The discharge valve hydraulic driving part 14 includes a cylinder 14*a* into which the water supplied from the discharge valve control valve 18 flows, a piston 14*b* slidably placed in the cylinder 14*a*, and a rod 15 that protrudes from a lower end of the cylinder 14*a* to drive the discharge valve 12. Furthermore, a spring 14*c* is placed inside the cylinder 14*a*, and urges the piston 14*b* downward, and a packing 14*e* is attached to the piston 14*b*, whereby the watertightness is achieved between an inner wall surface of the cylinder 14*a* and the piston 14*b*.

The cylinder 14*a* is a cylindrical member that is placed so that an axis thereof is oriented in the vertical direction, and slidably accommodates the piston 14*b* therein. The inflow pipe 23 is connected to a lower end portion of the cylinder 14*a* so that the water that has flowed out of the discharge valve control valve 18 flows into the cylinder 14*a*. Therefore, the piston 14*b* in the cylinder 14*a* is pushed up against the urging force of the spring 14*c* by the water that has flowed into the cylinder 14*a*.

On the other hand, an outflow hole is provided in an upper end portion of the cylinder 14*a*, and an outflow pipe 24 communicates with the interior of the cylinder 14*a* via the outflow hole. Accordingly, when the water flows into the cylinder 14*a* from the inflow pipe 23 connected to the lower portion of the cylinder 14*a*, the piston 14*b* is pushed up upward from the lower portion of the cylinder 14*a*. Then, when the piston 14*b* is pushed up to above the outflow hole, the water that has flowed into the cylinder 14*a* flows out of the outflow hole through the outflow pipe 24. That is, the inflow pipe 23 and the outflow pipe 24 communicate with each other via the interior of the cylinder 14*a* when the piston 14*b* is moved upward.

The outflow pipe 24 is split into two pipes in the middle, and a first descending pipe 24*b* branching downward opens downward above the overflow pipe 10*b*. The other second descending pipe 24*c* extends substantially horizontally, and then is curved downward so as to cause the water to flow out into the storage tank 10. Accordingly, a part of the flush water that, has flowed out of the cylinder 14*a* flows into the overflow pipe 10*b*, and the remainder of the flush water is stored in the storage tank 10.

The rod 15 is a rod-shaped member connected to a lower surface of the piston 14*b*, and extends to protrude downward from the inside of the cylinder 14*a* through a through hole 14*f* formed in a bottom surface of the cylinder 14*a*. The discharge valve 12 is connected to a lower end of the rod 15, and the rod 15 connects the piston 14*b* and the discharge valve 12. Therefore, when the water flows into the cylinder 14*a* and the piston 14*b* is pushed up, the rod 15 connected to the piston 14*b* lifts the discharge valve 12 upward, whereby the discharge valve 12 is opened.

A gap 14*d* is provided between the rod 15 protruding from below the cylinder 14*a* and an inner wall of the through hole 14*f* in the cylinder 14*a*, whereby a part of the water that has flowed into the cylinder 14*a* flows out of the gap 14*d*. The water that has flowed out of the gap 14*d* flows into the storage tank 10. Note that since the gap 14*d* is relatively narrow and has a large flow path resistance, the pressure inside the cylinder 14*a* is increased by the water flowing from the inflow pipe 23 into the cylinder 14*a* even in the state in which the water flows out of the gap 14*d*, whereby the piston 14*b* is pushed up against the urging force of the spring 14*c*.

The controller 28 incorporates a circuit board therein, and is configured to control the electromagnetic valve 20*a* for discharge control, the electromagnetic valve 20*b* for spout control, and the electromagnetic valve 20*c* for water supply control in response to the operation of the lever handle 8. A microprocessor, a memory an interface circuit, and the like are provided on the circuit board, and these are operated by software for controlling the toilet flush.

Next, an operation of the flush toilet device 1 according to the first embodiment of the present invention will be described with reference to FIG. 4.

Figure 4:
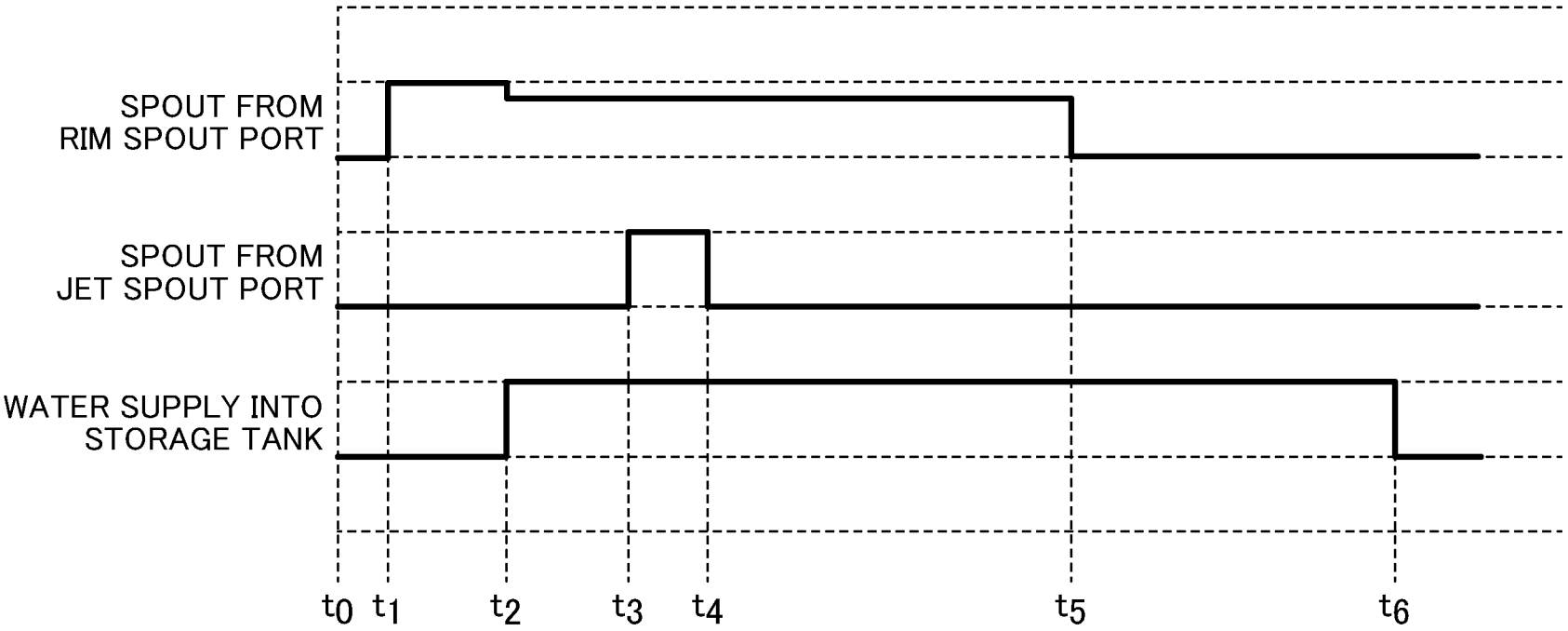
FIG. 4 is a time chart illustrating an example of toilet flush sequence by the flush toilet device of the first embodiment of the present invention.

FIG. 4 is a time chart illustrating an example of toilet flush sequence by the flush toilet device 1 of the first embodiment of the present invention, in which the upper sequence represents a spout flow rate from the rim spout port, the middle sequence represents a spout flow rate from the jet spout port, and the lower sequence represents a water supply flow rate to the storage tank.

First, in a wait state of the toilet flush at time to in FIG. 4, a water level in the storage tank 10 is a stopped water level $L_1$, and no energization is performed to the electromagnetic valve 20*a* for discharge control, the electromagnetic valve 20*b* for spout control, and the electromagnetic valve 20*c* for water supply control. In this state, both of the pilot valve port (not illustrated) to be opened and closed by the electromagnetic valve pilot valve 19*c* and the pilot valve port (not illustrated) to be opened and closed by the electromagnetic valve pilot valve 18*c* are closed. This brings the main valve body 18*b* of the discharge valve control valve 18 and the main valve body 19*b* of the spout control valve 19 into a valve closed state. In addition, the pilot valve port (not illustrated) to be opened and closed by the electromagnetic valve pilot valve 17*c* is closed, which also brings the main valve body 17*b* of the water supply control valve 17 into the valve closed state.

Next, when the user operates the lever handle 8 (FIG. 1) at time $t_1$ in FIG. 4, a signal instructing a toilet flush is transmitted to the controller 28 (FIG. 3). When receiving the instruction signal for a toilet flush, the controller 28 performs the energization to the electromagnetic valve 20*b* for spout control to open the electromagnetic valve pilot valve 19*c* of the spout control valve 19. This causes the pressure inside the pressure chamber of the spout control valve 19 to be decreased, whereby the main valve body 19*b* is detached from a valve seat and is opened. Note that in the present embodiment, since a bistable latching solenoid is used as the electromagnetic valve 20*b* for spout control, once the electromagnetic valve pilot valve 19*c* is opened, the valve open state is maintained even when the energization is stopped.

When the spout control valve 19 is opened, tap water supplied from the water supply pipe 32 to the spout control valve 19 via the water supply pipe branching portion 33 and the first branched pipe 33*a* flows into the rim water supply pipe 25 through the spout control valve 19. The flush water that has flowed into the rim water supply pipe 25 is spouted from the rim spout port 2*d* (FIG. 2) of the flush toilet main body 2. The flush water that has been spouted from the rim spout port 2*d* flows downward while swirling in the bowl 2*a* and washes a waste receiving surface of the bowl 2*a*. The water spout from the rim spout port 2*d* is performed as "pre-rim" spout to be performed before the water spout from the jet spout port 2*b* is started.

At time $t_2$ after a lapse of a predetermined time from when the energization is performed to the electromagnetic valve 20*b* for spout control, the controller 28 performs the energization to the electromagnetic valve 20*c* for water supply control, and detaches the electromagnetic valve pilot valve 17*c* from the pilot valve port (not illustrated). This causes the pressure inside the pressure chamber of the water supply control valve 17 to be decreased, whereby the main valve body 17*b* is detached from a valve seat and is opened. That is, the controller 28 causes the water supply control valve 17 to be opened while maintaining the valve open state of the spout control valve 19 after the spout control valve 19 is opened. Note that in the present embodiment, since a bistable latching solenoid is used as the electromagnetic valve 20*c* for water supply control, once the electromagnetic valve pilot valve 17*c* is opened, the valve open state is maintained even when the energization is stopped.

When the water supply control valve 17 is opened, tap water supplied from the water supply pipe 32 to the water supply control valve 17 via the water supply pipe branching portion 33 and the second branched pipe 33*b* flows into the storage tank 10 through the water supply control valve 17. That is, the controller 28 causes the water supply control valve 17 to be opened while maintaining the valve open state of the spout control valve 19 after the spout control valve 19 is opened. This enables the water spout from the rim spout port 2*d* and the water supply into the storage tank 10 to be performed at a time. Here, the flow rate of tap water flowing in the water supply pipe 32 is maintained substantially at constant by the fixed flow valve 32*b*. Therefore, when the water supply control valve 17 is further opened in the state in which the spout control valve 19 is open, the flow rate of the water flowing into the spout control valve 19 decreases, and the flow rate of the flush water spouted from the rim spout port 2*d* decreases when the water supply control valve 17 is opened.

At time $t_3$ after a lapse of a predetermined time from when the energization is performed to the electromagnetic valve 20*c* for water supply control, the controller 28 performs the energization to the electromagnetic valve 20*a* for discharge control, and detaches the electromagnetic valve pilot valve 18*c* from the pilot valve port (not illustrated). This causes the pressure inside the pressure chamber of the discharge valve control valve 18 to be decreased, whereby the main valve body 18*b* is detached from a valve seat and is opened. When the discharge valve control valve 18 is opened, tap water supplied from the water supply pipe 32 to the discharge valve control valve 18 via the water supply pipe branching portion 33 and the third branched pipe 33*c* flows into the inflow pipe 23 through the discharge valve control valve 18.

Furthermore, the flush water that has flowed into the inflow pipe 23 flows into the cylinder 14*a* of the discharge valve hydraulic driving part 14, and pushes up the piston 14*b*. Hereby the rod 15 connected to the piston 14*b* and the discharge valve 12 are also lifted up, whereby the discharge port 10*a* is opened. Hereby, the flush water stored in the storage tank 10 flows out through the discharge port 10*a*, and is spouted, as "jet spout water," from the jet spout port 2*b* (FIG. 2) provided in the lower portion of the bowl 2*a*. The flush water spouted from the jet spout port 2*b* fills the discharge trap conduit 2*e* extending from the lower portion of the bowl 2*a* and induces a siphon phenomenon. By the siphon phenomenon, pooled water and waste in the bowl 2*a* are drained through the discharge trap conduit 2*e*. In this way, the water spout from the rim spout port 2*d* is continued as "mid-rim" spout even while the flush water is being spouted from the jet spout port 2*b*. Therefore, when the discharge port 10*a* is opened, the flush water is spouted from both of the rim spout port 2*d* and the jet spout port 2*b* at a time.

In this way, in the flush toilet device 1 of the present embodiment, the supply of the flush water from the rim spout port 2*d* is continued even while the siphon phenomenon is occurring due to the flush water drained from the jet spout port 2*b*. Therefore, the pooled water is drawn by the siphon phenomenon, whereby the pooled water in the bowl 2*a* excessively decreases, which makes it possible to suppress a shortage of sealing water in the discharge trap conduit 2*e*. When a shortage of sealing water in the discharge trap conduit 2*e* occurs, an odor may flow backward from the discharge trap conduit 2*e*, but in the present embodiment, this can be suppressed. Since the supply of the flush water from the rim spout port 2*d* is continued even while the siphon phenomenon is occurring, the siphon phenomenon can be continued without shortage of the sealing water, and the siphon phenomenon can be prevented from terminating halfway. Note that the flow rate of the flush water spouted from the rim spout port 2*d* decreases when the water supply control valve 17 is opened at time $t_2$, but the flow rate sufficient to prevent the termination of the siphon phenomenon is ensured.

On the other hand, when the flush water flows from the inflow pipe 23 into the cylinder 14*a* of the discharge valve hydraulic driving part 14 and the piston 14*b* is pushed up to an upper portion of the cylinder 14*a*, the flush water in the cylinder 14*a* flows out through the outflow pipe 24. A part of the water that has flowed from the inflow pipe 23 into the cylinder 14*a* flows out of the gap 14*d* between the inner wall of the through hole 14*f* of the cylinder 14*a* and the rod 15, and then flows into the storage tank 10. On the other hand, a part of the flush water that has flowed out through the outflow pipe 24 flows into the overflow pipe 10*b*, and the remainder of the flush water flows into the storage tank 10. That is, a part of the flush water that has flowed out of the discharge valve hydraulic driving part 14 flows into the storage tank 10, and the remainder of the flush water that has flowed into the overflow pipe 10*b* bypasses the discharge valve 12 to flow into the flush toilet main body from the jet spout port 2*b*.

Furthermore, at time $t_4$ after a lapse of a predetermined time from when the discharge valve control valve 18 is opened at time $t_3$, the controller 28 transmits a control signal to the electromagnetic valve 20*a* for discharge control again to cause the electromagnetic valve pilot valve 18*c* to be closed. Hereby, the discharge valve control valve 18 is closed, and the supply of the flush water to the discharge valve hydraulic driving part 14 is stopped. Therefore, a pushing-up force of the piston 14*b* no longer acts on the piston 14*b* of the discharge valve hydraulic driving part 14, and the rod 15 and the discharge valve 12 start to be lowered. Next, the discharge port 10*a* of the storage tank 10 is closed by the discharge valve 12, and the spout of flush water from the jet spout port 2*b* is stopped, the flush water having flowed out of the discharge port 10*a*.

Furthermore, the water supply control valve 17 and the spout control valve 19 are open even after the discharge port 10*a* is closed, and therefore, the water supplied from the water supply pipe 32 is spouted from the rim spout port 2*d* to the bowl 2*a* and flows into the storage tank 10. Accordingly, the flush water spouted from the rim spout port 2*d* flows into the bowl 2*a* even after the discharge port 10*a* is closed, and the flush water that has flowed into the bowl 2*a* is used as refill water. The flush water that has flowed out of the tank water supply pipe 27 through the water supply control valve 17 flows into the storage tank 10, whereby the water level in the storage tank 10 rises.

Furthermore, the controller 28 transmits a control signal to the electromagnetic valve 20*b* for spout control at time $t_5$, to cause the electromagnetic valve pilot valve 19*c* of the spout control valve 19 to be closed. Hereby, the spout control valve 19 is closed, and the water spout from the rim spout port 2*d* of the flush toilet main body 2 is stopped. In this way, the water spout from the rim spout port 2*d* is performed as "post-rim" spouting to be performed after the termination of the jet spout, and the flush water spouted from the rim spout port 2*d* flows into the bowl 2*a*, and is used as refill water. The water supply control valve 17 is maintained in the valve-open state even after the spout control valve 19 is closed, and the flush water flows into the storage tank 10 through the tank water supply pipe 27.

Next, at time $t_6$, the controller 28 transmits a control signal to the electromagnetic valve 20*c* for water supply control at the timing when the water level in the storage tank 10 has risen to a predetermined stopped water level $L_1$, to cause the electromagnetic valve pilot valve 17*c* of the water supply control valve 17 to be closed. This causes the water supply control valve 17 to be closed, whereby the water supply into the storage tank 10 is stopped. Thus, one toilet flush by the flush toilet device 1 is completed.

According to the flush toilet device 1 of the first embodiment of the present invention, since the water is spouted from the rim spout port 2*d* serving as the upper spout port and is supplied into the storage tank 10 at a time (time $t_2$ in FIG. 4), the water is supplied into the storage tank 10 while the water is spouted from the rim spout port 2*d* to wash the flush toilet main body 2, which makes it possible to shorten the time until a next flush can be performed after one toilet flush is performed.

According to the flush toilet device 1 of the present invention, the flush water spouted from the rim spout port 2*d* is reduced when the water supply control valve 17 serving as the second on-off valve is opened and the water supply into the storage tank 10 is started, which makes it possible to supply, to the rim spout port 2*d*, the flush water of a sufficient amount required to prolong the siphon action and to suppress occurrence of wasteful water.

Furthermore, according to the flush toilet device 1 of the present invention, the spout of the flush water from the rim spout port 2*d* and the water supply to the storage tank 10 can be controlled independently by the spout control valve 19 and the water supply control valve 17, respectively, whereby the water can be supplied to the storage tank 10 at an arbitrary timing while continuing the spout of the water from the rim spout port 2*d*. This enables the water to be supplied to the storage tank 10 without inhibiting the toilet flush.

According to the flush toilet device 1 of the present invention, the flush water that has flowed through the discharge valve hydraulic driving part 14 flows into the storage tank 10, whereby the flush water used for driving the discharge valve 12 can be also used, without waste, for the next toilet flush, which makes it possible to enhance the use efficiency of the flush water.

According to the flush toilet device 1 of the present invention, a part of the flush water that has flowed out of the discharge valve hydraulic driving part 14 flows into the storage tank 10, and the remainder flows into the flush toilet main body 2 from the jet spout port 2*b*, which makes it possible to appropriately distribute the flush water into the next flush and the refill and to use the supplied flush water efficiently.

Next, a flush toilet device according to a second embodiment of the present invention will be described with reference to FIGS. 5 and 6.

The flush toilet device of the present embodiment is different from that in the above-described first embodiment in a configuration of a flush water tank device included therein. Hereinafter, only portions of the second embodiment of the present invention which are different from those of the first embodiment will be described, and overlapping description of the same configuration, actions and effects as those in the first embodiment is omitted.

Figure 5:
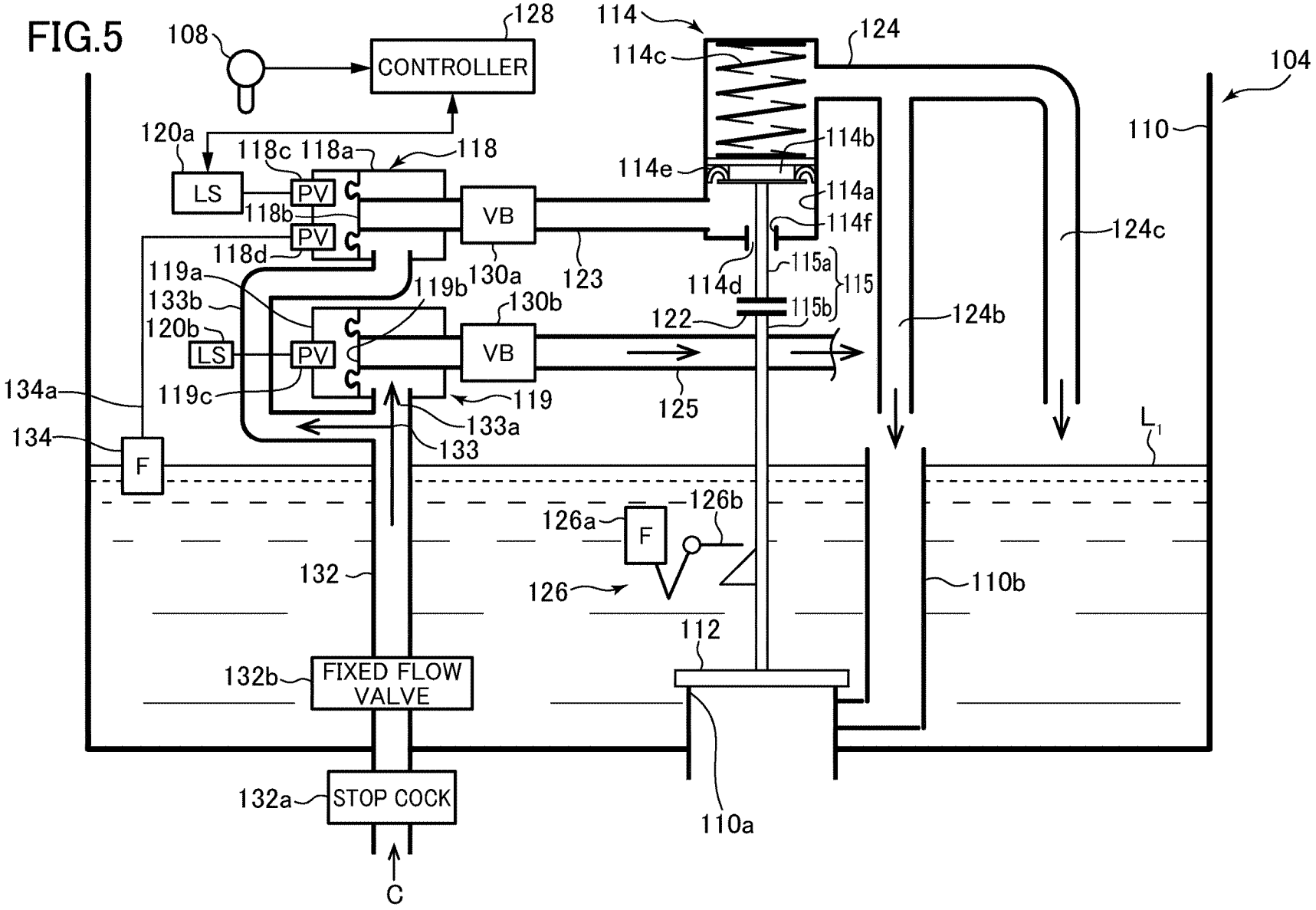
FIG. 5 is a cross-sectional view illustrating a schematic configuration of a flush water tank device included in a flush toilet device of a second embodiment of the present invention.

FIG. 5 is a cross-sectional view illustrating a schematic configuration of a flush water tank device included in the flush toilet device of the second embodiment of the present invention.

As illustrated in FIG. 5, a flush water tank device 104 included in the flush toilet device of the present embodiment includes a storage tank 110, a discharge valve 112 that opens and closes a discharge port 110*a* of the storage tank 110, and a discharge valve hydraulic driving part 114 serving as the hydraulic driving mechanism that drives the discharge valve 112. Furthermore, the flush water tank device 104 includes a spout control valve 119 serving as the first on-off valve that controls spout and stop of the flush water from the rim spout port 2*d* (FIG. 2), a water supply control valve 118 serving as the second on-off valve that switches between supply and stop of the flush water into the flush water tank device 104, and a controller 128 serving as the controller that controls these control valves.

The storage tank 110 is a tank configured to store the flush water to be supplied to the jet spout port 2*b* (FIG. 2) of the flush toilet main body 2, and the discharge port 110*a* for discharging the stored flush water into the flush toilet main body 2 is formed in a bottom portion of the storage tank 110. In the storage tank 110, an overflow pipe 110*b* is connected to a downstream side of the discharge port 110*a*. The overflow pipe 110*b* rises vertically from near the discharge port 110*a* and extends above a stopped water level $L_1$ of the flush water stored in the storage tank 110. Accordingly, the flush water that has flowed in from an upper end of the overflow pipe 110*b* bypasses the discharge port 110*a* to directly flow out of the jet spout port 2*b* of the flush toilet main body 2.

The discharge valve 112 is a valve body placed to open and close the discharge port 110*a*, and is opened when the discharge valve 112 is pulled up upward, whereby the flush water in the storage tank 110 is drained into the flush toilet main body 2 and is spouted from the jet spout port 2*b* provided in the lower portion of the bowl 2*a* (FIG. 2).

On the other hand, the flush water supplied from the waterworks C to a water supply pipe 132 flows into a water supply pipe branching portion 133 serving as the branching portion, via a stop cock 132*a* and a fixed flow valve 132*b*. The water supply pipe branching portion 133 splits flush water supplied from the waterworks C into a first branched pipe 133*a* serving as the first branched flow path and a second branched pipe 133*b* serving as the second branched flow path. In addition, the spout control valve 119 is provided in the first branched pipe 133*a*, and the water supply control valve 118 is provided in the second branched pipe 133*b*. Note that the stop cock 132*a* is placed outside the storage tank 110, and, on the downstream side thereof, is connected to the fixed flow valve 132*b* in the storage tank 110, and the water supply pipe branching portion 133 is provided on the downstream side of the fixed flow valve 132*b*.

The stop cock 132*a* is provide to stop the water supply to the flush water tank device 104 at the time of maintenance or the like, and is normally used in an open state. The fixed flow valve 132*b* is provided to cause the water supplied from the waterworks C to flow into the water supply pipe branching portion 133 at a predetermined flow rate, and is configured to supply the water to the flush water tank device 104 at a constant flow rate regardless of placement environment of the flush toilet device.

On the other hand, the spout control valve 119 provided in the first branched pipe 133*a* is configured to cause the water supplied from the first branched pipe 133*a* to flow out to the rim water supply pipe 125. The rim water supply pipe 125 communicates with the rim spout port 2*d* (FIG. 2) of the flush toilet main body 2 (not illustrated in FIG. 5), and spouts, from the rim spout port 2*d*, the flush water that has flowed into the rim water supply pipe 125, as rim flush water for washing the bowl. A vacuum breaker 130*b* is provided in the middle of the rim water supply pipe 125. This can prevent the water from flowing backward from a side of the flush toilet main body to the spout control valve 119 when the spout control valve 119 side is brought into a negative pressure.

The spout control valve 119 includes a spout valve main body 119*a*, a main valve body 119*b* placed in the spout valve main body 119*a*, and an electromagnetic valve pilot valve 119*c*. The spout control valve 119 is connected to an electromagnetic valve 120*b* for spout control and is configured so that the electromagnetic valve pilot valve 119*c* is movable by the electromagnetic valve 120*b* for spout control. That is, the electromagnetic valve pilot valve 119*c* is configured to open and close a pilot valve port (not illustrated) provided in the spout valve main body 119*a*. When the pilot valve port (not illustrated) is opened, the pressure inside a pressure chamber provided in the spout valve main body 119*a* decreases, and the main valve body 119*b* of the spout control valve 119 is opened. In addition, when the pilot valve port (not illustrated) is closed, the pressure inside the pressure chamber increases, and the main valve body 119*b* is closed. Accordingly, the main valve body 119*b* of the spout control valve 119 is opened and closed in response to the operation of the electromagnetic valve 120*b* for spout control to thereby control supply and stop of the water to the rim spout port 2*d* (FIG. 2).

Next, the water supply control valve 118 provided in the second branched pipe 133*b* is configured to cause the water supplied from the second branched pipe 133*b* to flow out to the discharge valve hydraulic driving part 114. The water supply control valve 118 includes a control valve main body 118*a*, a main valve body 118*b* placed in the control valve main body 118*a*, an electromagnetic valve pilot valve 118*c*, and a float pilot valve 118*d*. Furthermore, an electromagnetic valve 120*a* for water supply control and a control valve float 134 are connected to the water supply control valve 118.

The electromagnetic valve 120*a* for water supply control is configured to move the electromagnetic valve pilot valve 118*c* incorporated in the water supply control valve 118 to open and close a pilot valve port (not illustrated) on the basis of a signal transmitted from the controller 128. When the pilot valve port (not illustrated) is opened, the pressure inside a pressure chamber provided in the control valve main body 118*a* decreases, and the main valve body 118*b* of the water supply control valve 118 is opened. In addition, when the pilot valve port (not illustrated) is closed, the pressure inside the pressure chamber increases, and the main valve body 118*b* is closed. Accordingly, the main valve body 118*b* of the water supply control valve 118 is opened and closed in response to the operation of the electromagnetic valve 120*a* for water supply control to thereby control supply and stop of the water to the discharge valve hydraulic driving part 114. Note that in the present embodiment, as the electromagnetic valve 120*a* for water supply control, there is used a bistable latching solenoid that moves the electromagnetic valve pilot valve 118*c* when the energization is performed once, and maintains this state even when the energization is stopped. This type of electromagnetic valve can return the electromagnetic valve pilot valve 118*c* to an original position when the energization is performed again in the opposite direction.

Furthermore, a control valve float 134 is also connected to the water supply control valve 118 so that the float pilot valve 118*d* is moved in response to the movement of the control valve float 134. That is, the control valve float 134 is placed in the storage tank 110, and rises with the rise of the water level in the storage tank 110, whereby the float pilot valve 118*d* is moved via an arm portion 134*a*. When the water level in the storage tank 110 rises to the stopped water level $L_1$, the float pilot valve 118*d* closes the pilot valve port (not illustrated) of the control valve main body 118*a*.

In this way, the float pilot valve 118*d* is configured to control the pressure inside the pressure chamber provided in the control valve main body 118*a* by opening and closing the pilot valve port (not illustrated). As a result, when both of the pilot valve port (not illustrated) to be opened and closed by the float pilot valve 118*d* and the pilot valve port (not illustrated) to be opened and closed by the electromagnetic valve pilot valve 118*c* are closed, the pressure inside the pressure chamber in the control valve main body 118*a* rises, and the main valve body 118*b* is closed.

Note that, in a wait state of the flush water tank device 104, the water level in the storage tank 110 is the stopped water level $L_1$, and in this state, the pilot valve port (not illustrated) to be opened and closed by the float pilot valve 118*d* is closed. Accordingly, in the wait state, the electromagnetic valve pilot valve 118*c* is moved in response to the operation of the electromagnetic valve 120*a* for water supply control, whereby the pilot valve port (not illustrated) is opened, which can cause the main valve body 118*b* of the water supply control valve 118 to be opened.

Specifically, the controller 128 receives a signal from a lever handle 108, and transmits an electric signal to the electromagnetic valve 120*a* for water supply control, to actuate the electromagnetic valve 120*a* for water supply control, which causes the water supply control valve 118 to be opened. The water supply control valve 118 controls supply and stop of the supplied flush water to the discharge valve hydraulic driving part 114 on the basis of an instruction signal from the controller 128 serving as the controller. In the present embodiment, the total amount of the flush water that has flowed out of the water supply control valve 118 is supplied to the discharge valve hydraulic driving part 114 through an inflow pipe 123.

A vacuum breaker 130*a* is provided in the inflow pipe 123 that connects the water supply control valve 118 and the discharge valve hydraulic driving part 114. If the water supply control valve 118 side is brought into a negative pressure by this vacuum breaker 130*a*, outside air is drawn into the inflow pipe 123, which can prevent the water from flowing backward from the discharge valve hydraulic driving part 114 side.

Next, the discharge valve hydraulic driving part 114 is configured to drive the discharge valve 112 using the water supply pressure of the flush water supplied from the waterworks C. Specifically, the discharge valve hydraulic driving part 114 includes a cylinder 114*a* into which the water supplied from the water supply control valve 118 flows, a piston 114*b* slidably placed in the cylinder 114*a*, and a rod 115 that protrudes from a lower end of the cylinder 114*a* to drive the discharge valve 112. Furthermore, a spring 114*c* is placed inside the cylinder 114*a*, and urges the piston 114*b* downward, and a packing 114*e* is attached to the piston 114*b*, whereby the watertightness is achieved between an inner wall surface of the cylinder 114*a* and the piston 114*b*.

The cylinder 114*a* is a cylindrical member that is placed so that an axis thereof is oriented in the vertical direction, and slidably accommodates the piston 114*b* therein. The inflow pipe 123 is connected to a lower end portion of the cylinder 114*a* so that the water that has flowed out of the water supply control valve 118 flows into the cylinder 114*a*. Therefore, the piston 114*b* in the cylinder 114*a* is pushed up against the urging force of the spring 114*c* by the water that has flowed into the cylinder 114*a*.

On the other hand, an outflow hole is provided in an upper end portion of the cylinder 114*a*, and an outflow pipe 124 communicates with the interior of the cylinder 114*a* via the outflow hole. Accordingly, when the water flows into the cylinder 114*a* from the inflow pipe 123 connected to the lower portion of the cylinder 114*a*, the piston 114*b* is pushed up upward from the lower portion of the cylinder 114*a*. Then, when the piston 114*b* is pushed up to above the outflow hole, the water that has flowed into the cylinder 114*a* flows out of the outflow hole through the outflow pipe 124. That is, the inflow pipe 123 and the outflow pipe 124 communicate with each other via the interior of the cylinder 114*a* when the piston 114*b* is moved upward.

The outflow pipe 124 is split into two pipes in the middle, and a first descending pipe 124*b* branching downward opens downward above the overflow pipe 110*b*. The other second descending pipe 124*c* extends substantially horizontally, and then is curved downward so as to cause the water to flow out into the storage tank 110. Accordingly, a part of the flush water that has flowed out of the cylinder 114*a* flows into the overflow pipe 110*b*, and the remainder of the flush water is stored in the storage tank 110.

The rod 115 is a rod-shaped member connected to a lower surface of the piston 114*b*, and extends to protrude downward from the inside of the cylinder 114*a*, through a through hole 114*f* formed in a bottom surface of the cylinder 114*a*. The discharge valve 112 is connected to a lower end of the rod 115, and the rod 115 connects the piston 114*b* and the discharge valve 112. Therefore, when the water flows into the cylinder 114*a* and the piston 114*b* is pushed up, the rod 115 connected to the piston 114*b* lifts the discharge valve 112 upward, whereby the discharge valve 112 is opened.

A gap 114*d* is provided between the rod 115 protruding from below the cylinder 114*a* and an inner wall of the through hole 114*f* in the cylinder 114*a*, whereby a part of the water that has flowed into the cylinder 114*a* flows out of the gap 114*d*. The water that has flowed out of the gap 114*d* flows into the storage tank 110. Note that since the gap 114*d* is relatively narrow and has a large flow path resistance, the pressure inside the cylinder 114*a* is increased by the water flowing from the inflow pipe 123 into the cylinder 114*a* even in the state in which the water flows out of the gap 114*d*, whereby the piston 114*b* is pushed up against the urging force of the spring 114*c*.

Furthermore, a clutch mechanism 122 is provided in the middle of the rod 115. The clutch mechanism 122 is configured to separate the rod 115 into an upper rod 115*a* and a lower rod 115*b* when the discharge valve 112 is lifted up by a predetermined distance together with the rod 115. In a state in which the clutch mechanism 122 is disengaged, the lower rod 115*b* ceases to move in association with the movement of the upper portion including the piston 114*b* and the upper rod 115*a*, and falls by gravity together with the discharge valve 112 while resisting buoyancy.

In addition, a discharge valve float mechanism 126 is provided in the vicinity of the discharge valve 112. The discharge valve float mechanism 126 is configured to delay closing of the discharge port 110*a* when the lower rod 115*b* and the discharge valve 112 are falling after the rod 115 is lifted up by a predetermined distance and the lower rod 115*b* is separated by the clutch mechanism 122. Specifically, the discharge valve float mechanism 126 includes a float portion 126*a* and an engaging portion 126*b* that moves in association with the float portion 126*a*.

The engaging portion 126*b* is configured to engage with the lower rod 115*b* falling after being separated by the clutch mechanism 122 to prevent the lower rod 115*b* and the discharge valve 112 from falling to be seated on the discharge port 110*a*. Next, when the float portion 126*a* is moved down with the lowering of the water level in the storage tank 110 and the water level in the storage tank 110 is lowered to a predetermined water level, the float portion 126*a* turns the engaging portion 126*b* to release the engagement between the engaging portion 126*b* and the lower rod 115*b*. When the engagement is released, the lower rod 115*b* and the discharge valve 112 fall and are seated on the discharge port 110*a*. This enables the delay of closing of the discharge valve 112, so that an appropriate amount of flush water can be drained from the discharge port 110*a*.

The controller 128 incorporates a circuit board therein, and is configured to control the electromagnetic valve 120*a* for water supply control, the electromagnetic valve 120*b* for spout control, and the like in response to the operation of the lever handle 108. A microprocessor, a memory, an interface circuit, and the like are provided on the circuit board, and these are operated by software for controlling the toilet flush.

Next, an operation of the flush toilet device according to the second embodiment of the present invention will be described with reference to FIG. 6. FIG. 6 is a time chart illustrating an example of toilet flush sequence by the flush toilet device of the second embodiment of the present invention, in which the upper sequence represents a spout flow rate from the rim spout port, the middle sequence represents a spout flow rate from the jet spout port, and the lower sequence represents a water supply flow rate to the storage tank.

Figure 6:
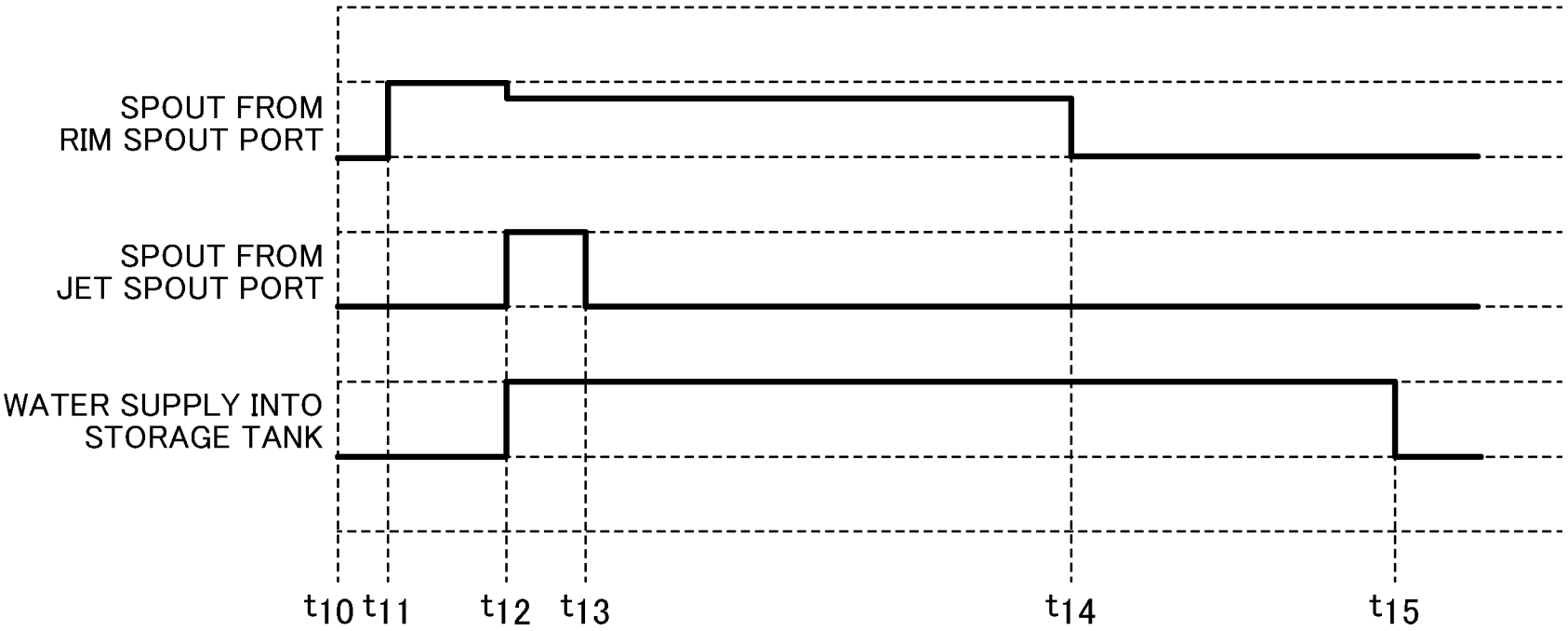
FIG. 6 is a time chart illustrating an example of toilet flush sequence by the flush toilet device of the second embodiment of the present invention.

First, in a wait state of the toilet flush at time $t_{10}$ in FIG. 6, a water level in the storage tank 110 is a stopped water level $L_1$, and no energization is performed to the electromagnetic valve 120*a* for water supply control and the electromagnetic valve 120*b* for spout control. In this state, all of the pilot valve port (not illustrated) to be opened and closed by the electromagnetic valve pilot valve 119*c*, the pilot valve port (not illustrated) to be opened and closed by the electromagnetic valve pilot valve 118*c*, and the pilot valve port (not illustrated) to be opened and closed by float pilot valve 118*d* are closed. This brings the main valve body 118*b* of the water supply control valve 118 and the main valve body 119*b* of the spout control valve 119 into a valve closed state.

Next, when the user operates the lever handle 108 at time $t_{11}$ FIG. 6, a signal instructing a toilet flush is transmitted to the controller 128 (FIG. 5). When receiving the instruction signal for a toilet flush, the controller 128 performs the energization to the electromagnetic valve 120*b* for spout control to open the electromagnetic valve pilot valve 119*c* of the spout control valve 119. This causes the pressure in the pressure chamber of the spout control valve 119 to be decreased, whereby the main valve body 119*b* is detached from a valve seat and is opened. Note that in the present embodiment, since a bistable latching solenoid is used as the electromagnetic valve 120*b* for spout control, once the electromagnetic valve pilot valve 119*c* is opened, the valve open state is maintained even when the energization is stopped.

When the spout control valve 119 is opened, tap water supplied from the water supply pipe 132 to the spout control valve 119 via the water supply pipe branching portion 133 and the first branched pipe 133*a* flows into the rim water supply pipe 125 through the spout control valve 119. The flush water that has flowed into the rim water supply pipe 125 is spouted from the rim spout port 2*d* (FIG. 2) of the flush toilet main body. The flush water that has been spouted from the rim spout port 2*d* flows downward while swirling in the bowl 2*a* and washes a waste receiving surface of the bowl 2*a*. The water spout from the rim spout port 2*d* is performed as "pre-rim" spout to be performed before the water spout from the jet spout port 2*b* is started.

At time $t_{12}$ after a lapse of a predetermined time from when the energization is performed to the electromagnetic valve 120*b* for spout control, the controller 128 performs the energization to the electromagnetic valve 120*a* for water supply control, and detaches the electromagnetic valve pilot valve 118*c* from the pilot valve port (not illustrated). This causes the pressure in the pressure chamber of the water supply control valve 118 to be decreased, whereby the main valve body 118*b* is detached from a valve seat and is opened. That is, the controller 128 causes the water supply control valve 118 to be opened while maintaining the valve open state of the spout control valve 119 after the spout control valve 119 is opened. Note that in the present embodiment, since a bistable latching solenoid is used as the electromagnetic valve 120*a* for water supply control, once the electromagnetic valve pilot valve 118*c* is opened, the valve open state is maintained even when the energization is stopped.

When the water supply control valve 118 is opened, tap water supplied from the water supply pipe 132 to the water supply control valve 118 via the water supply pipe branching portion 133 and the second branched pipe 133*b* flows into the storage tank 110 through the water supply control valve 118. That is, the controller 128 causes the water supply control valve 118 to be opened while maintaining the valve open state of the spout control valve 119 after the spout control valve 119 is opened.

As described above, the flush water that has flowed out of the water supply control valve 118 flows into the cylinder 114*a* of the discharge valve hydraulic driving part 114 through the inflow pipe 123, and flows out of the outflow pipe 124. A part of the water that has flowed from the inflow pipe 123 into the cylinder 114*a* flows out of the gap 114*d* between the inner wall of the through hole 114*f* of the cylinder 114*a* and the rod 115, and then flows into the storage tank 110. On the other hand, a part of the flush water that has flowed out through the outflow pipe 124 flows into the overflow pipe 110*b*, and the remainder of the flush water flows into the storage tank 110. That is, a part of the flush water that has flowed out of the discharge valve hydraulic driving part 114 flows into the storage tank 110, and the remainder of the flush water that has flowed into the overflow pipe 110*b* bypasses the discharge valve 112 to flow into the flush toilet main body from the jet spout port 2*b*.

Accordingly, after $t_{12}$ in FIG. 6, the water spout from the rim spout port 2*d* and the water supply into the storage tank 110 are performed at a time. Here, the flow rate of tap water flowing in the water supply pipe 132 is maintained substantially at constant by the fixed flow valve 132*b*. Therefore, when the water supply control valve 118 is further opened in the state in which the spout control valve 119 is open, the flow rate of the water flowing into the spout control valve 119 decreases, and the flow rate of the flush water spouted from the rim spout port 2*d* decreases when the water supply control valve 118 is opened.

On the other hand, the flush water that has flowed from the inflow pipe 123 into the cylinder 114*a* of the discharge valve hydraulic driving part 114 pushes up the piston 114*b*. Hereby the rod 115 connected to the piston 114*b* and the discharge valve 112 are also lifted up, whereby the discharge port 110*a* is opened. Hereby, the flush water stored in the storage tank 110 flows out through the discharge port 110*a*, and is spouted, as "jet spout water," from the jet spout port 2*b* (FIG. 2) provided in the lower portion of the bowl 2*a*. The flush water spouted from the jet spout port 2*b* fills the discharge trap conduit 2*e* extending from the lower portion of the bowl 2*a* and induces a siphon phenomenon. By the siphon phenomenon, pooled water and waste in the bowl 2*a* are drained through the discharge trap conduit 2*e*. In this way, the water spout from the rim spout port 2*d* is continued as "mid-rim" spout even while the flush water is being spouted from the jet spout port 2*b*. Therefore, when the discharge port 110*a* is opened, the flush water is spouted from both of the rim spout port 2*d* and the jet spout port 2*b* at a time.

In this way, in the flush toilet device of the present embodiment, the supply of the flush water from the rim spout port 2*d* is continued even while the siphon phenomenon is occurring due to the flush water drained from the jet spout port 2*b*. Therefore, the pooled water is drawn by the siphon phenomenon, whereby the pooled water in the bowl 2*a* excessively decreases, which makes it possible to suppress a shortage of sealing water in the discharge trap conduit 2*e*. When a shortage of sealing water in the discharge trap conduit 2*e* occurs, an odor may flow backward from the discharge trap conduit 2*e*, but in the present embodiment, this can be suppressed. Since the supply of the flush water from the rim spout port 2*d* is continued even while the siphon phenomenon is occurring, the siphon phenomenon can be continued without shortage of the sealing water, and the siphon phenomenon can be prevented from terminating halfway. Note that the flow rate of the flush water spouted from the rim spout port 2*d* decreases when the water supply control valve 118 is opened at time $t_{12}$, but the flow rate sufficient to prevent the termination of the siphon phenomenon is ensured.

On the other hand, when the piston 114*b* is pushed up in the discharge valve hydraulic driving part 114 and accordingly the rod 115 and the discharge valve 112 are lifted up to a predetermined position, the clutch mechanism 122 separates the lower rod 115*b* and the discharge valve 112 from the upper rod 115*a*. Hereby during the opening of the water supply control valve 118, the upper rod 115*a* remains pushed up upward together with the piston 114*b*, while the lower rod 115*b* and the discharge valve 112 fall by their own weight. However, the separated lower rod 115*b* engages with the engaging portion 126*b* of the discharge valve float mechanism 126, thereby stopping the fall of the lower rod 115*b* and the discharge valve 112. Hereby, the discharge port 110*a* of the storage tank 110 remains open even after the clutch mechanism 122 is disengaged, and the water discharge from the storage tank 110 is continued.

As described above, a part of the flush water that has flowed out of the discharge valve hydraulic driving part 114 flows into the storage tank 110. However, since the flow rate of the flush water that flows into the storage tank 110 through the outflow pipe 124 is lower than the flow rate of the flush water drained from the discharge port 110*a* when the discharge valve 112 is opened, the water level in the storage tank 110 is lowered in this state.

Next, when the flush water in the storage tank 110 is drained, the water level in the storage tank 110 is lowered, and therefore the control valve float 134 is lowered. Hereby, after the discharge valve 112 is opened at time $t_{12}$, the arm portion 134*a* is turned, the float pilot valve 118*d* is detached from the pilot valve port (not illustrated), and the pilot valve port (not illustrated) is opened.

Furthermore, after the float pilot valve 118*d* is opened, the controller 128 transmits a control signal to the electromagnetic valve 120*a* for water supply control again, to cause the electromagnetic valve pilot valve 118*c* to be closed. However, since the float pilot valve 118*d* is open at this time, the water supply control valve 118 is maintained in the valve open state without causing an increase in the pressure inside the pressure chamber of the water supply control valve 118.

Next, when the flush water in the storage tank 110 is drained from the discharge port 110*a* and the water level in the storage tank 110 is lowered to a predetermined water level, the float portion 126*a* of the discharge valve float mechanism 126 is lowered, which causes the engaging portion 126*b* to move. Hereby, the engagement between the lower rod 115*b* and the engaging portion 126*b* is released, and the lower rod 115*b* and the discharge valve 112 start to be lowered again. Then, at time $t_{13}$, the discharge port 110*a* of the storage tank 110 is closed by the discharge valve 112, and the spout of flush water from the jet spout port 2*b* is stopped, the flush water having flowed out of the discharge port 110*a*. In this way, the water spout from the rim spout port 2*d* is continued as "post-rim" spout to be performed after the termination of the jet spout, and the flush water spouted from the rim spout port 2*d* flows into the bowl 2*a*, and is used as refill water.

Furthermore, at time $t_{14}$ after a lapse of a predetermined time from when the spout control valve 119 is opened at time $t_{11}$, the controller 128 transmits a control signal to the electromagnetic valve 120*b* for spout control to cause the electromagnetic valve pilot valve 119*c* to be closed. Hereby, the spout control valve 119 is closed, and the spout of the flush water from the rim spout port 2*d* is stopped.

Furthermore, since the water supply control valve 118 is open even after the water spout from the rim spout port 2*d* is stopped, the water supplied from the water supply pipe 132 flows into the storage tank 110 and the overflow pipe 110*b* through the cylinder 114*a* of the discharge valve hydraulic driving part 114. Accordingly, the flush water that has flowed into the overflow pipe 110*b* flows into the bowl 2*a* through the jet spout port 2*b* even after the discharge port 110*a* is closed, and the flush water that has flowed into the bowl 2*a* is used as refill water. The flush water flows into the storage tank 110 through the discharge valve hydraulic driving part 114, whereby the water level in the storage tank 110 rises.

Next, at time $t_{15}$, when the water level in the storage tank 110 rises to a predetermined stopped water level $L_1$, the control valve float 134 rises, and the float pilot valve 118*d* is moved via the arm portion 134*a*, whereby the pilot valve port is closed. Hereby both of the electromagnetic valve pilot valve 118*c* and the float pilot valve 118*d* are closed, and therefore, the pressure inside the pressure chamber in the control valve main body 118*a* is increased to close the main valve body 118*b*, whereby the water supply control valve 118 is brought into the valve closed state. Accordingly, the water supply into the storage tank 110 is stopped.

On the other hand, when the water supply control valve 118 is closed and the water supply to the discharge valve hydraulic driving part 114 is stopped, the piston 114*b* of the discharge valve hydraulic driving part 114 is pushed down by the urging force of the spring 114*c*. When the upper rod 115*a* is pushed down together with the piston 114*b*, the upper rod 115*a* and the lower rod 115*b* that have been separated from each other by the clutch mechanism 122 are connected again. Therefore, when next toilet flush is performed, the upper rod 115*a* and the lower rod 115*b* are lifted up by the piston 114*b*. As described above, one toilet flush is completed, and the flush toilet device returns to the wait state of the toilet flush.

According to the flush toilet device of the second embodiment of the present invention, the discharge valve hydraulic driving part 114 drives the discharge valve 112 when the flush water that has flowed out of the water supply control valve 118 serving as the second on-off valve is supplied, whereby the water supply control valve 118 can be used to control the water supply to the storage tank 110 and the discharge valve 112, which makes it possible to simplify a configuration of the flush toilet device.

According to the flush toilet device of the present embodiment, the flush water that has flowed through the discharge valve hydraulic driving part 114 flows into the storage tank 110, whereby the flush water used for driving the discharge valve 112 can be also used, without waste, for the next toilet flush, which makes it possible to enhance the use efficiency of the flush water.

According to the flush toilet device of the present embodiment, a part of the flush water that has flowed out of the discharge valve hydraulic driving part 114 flows into the storage tank 110, and the remainder flows into the flush toilet main body 2 from the jet spout port 2*b* serving as the lower spout port, which makes it possible to appropriately distribute the flush water into the next flush and the refill and to use the supplied flush water efficiently.

Next, a flush toilet device according to a third embodiment of the present invention will be described with reference to FIGS. 7 and 8.

The flush toilet device of the present embodiment is different from that in the above-described first and second embodiment in a configuration of a flush water tank device included therein. Hereinafter, only portions of the third embodiment of the present invention which are different from those of the first embodiment will be described, and overlapping description of the same configuration, actions and effects as those in the first embodiment is omitted.

Figure 7:
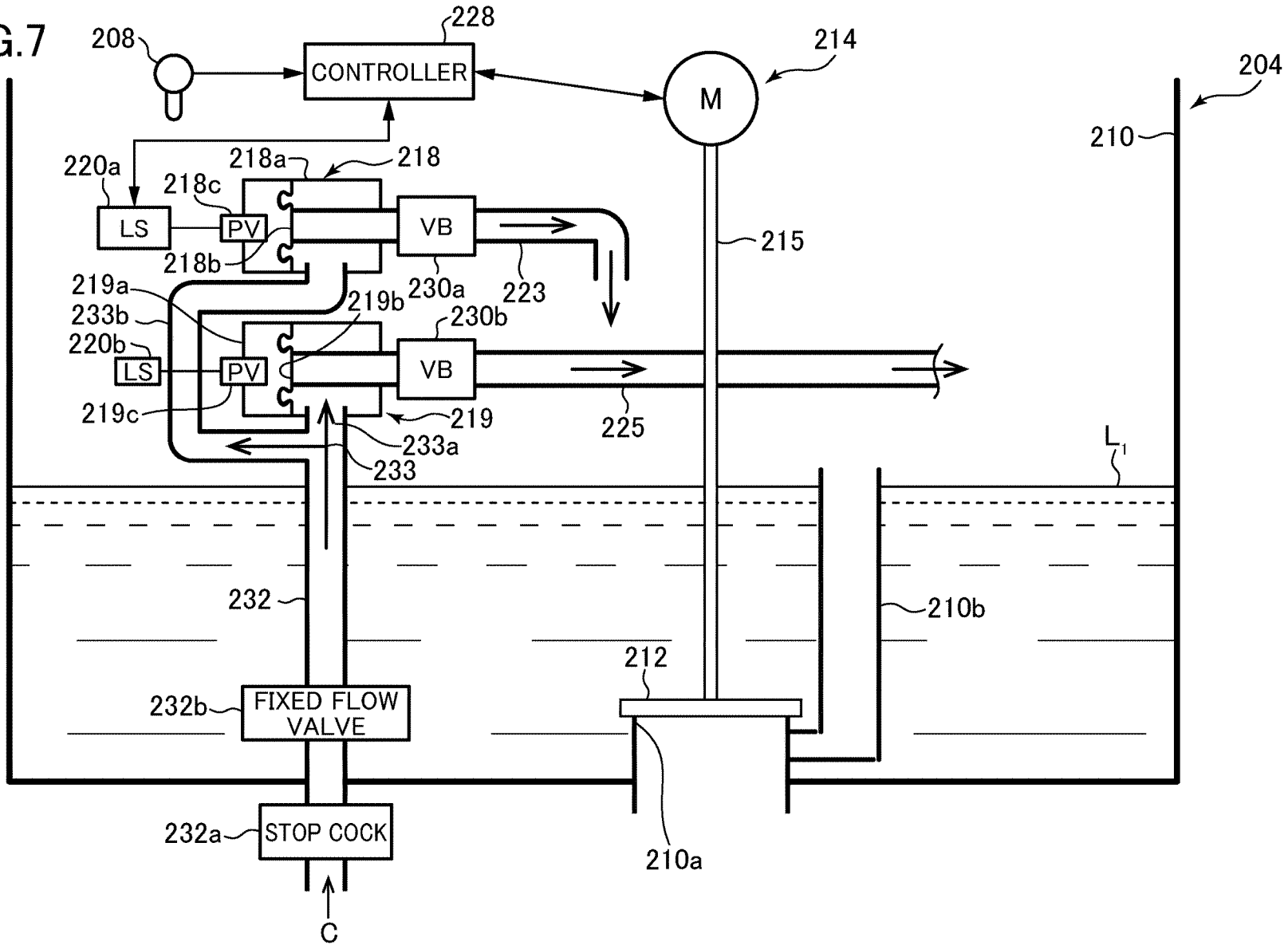
FIG. 7 is a cross-sectional view illustrating a schematic configuration of a flush water tank device included in a flush toilet device of a third embodiment of the present invention.

FIG. 7 is a cross-sectional view illustrating a schematic configuration of a flush water tank device included in the flush toilet device of the third embodiment of the present invention.

As illustrated in FIG. 7, a flush water tank device 204 included in the flush toilet device of the present embodiment includes a storage tank 210, a discharge valve 212 that opens and closes a discharge port 210*a* of the storage tank 210, and a discharge valve operation device 214 that drives the discharge valve 212. Furthermore, the flush water tank device 204 includes a spout control valve 219 serving as the first on-off valve that controls spout and stop of the flush water from the rim spout port 2*d* (FIG. 2), a water supply control valve 218 serving as the second on-off valve that switches between supply and stop of the flush water into the flush water tank device 204, and a controller 228 serving as the controller that controls these control valves.

The storage tank 210 is a tank configured to store the flush water to be supplied to the jet spout port 2*b* (FIG. 2) of the flush toilet main body 2, and the discharge port 210*a* for discharging the stored flush water into the flush toilet main body 2 is formed in a bottom portion of the storage tank 210. In the storage tank 210, an overflow pipe 210*b* is connected to a downstream side of the discharge port 210*a*. The overflow pipe 210*b* rises vertically from near the discharge port 210*a* and extends above a stopped water level $L_1$ of the flush water stored in the storage tank 210. Accordingly, the flush water that has flowed in from an upper end of the overflow pipe 210*b* bypasses the discharge port 210*a* to directly flow out of the jet spout port 2*b* of the flush toilet main body 2.

The discharge valve 212 is a valve body placed to open and close the discharge port 210*a*, and is opened when the discharge valve 212 is pulled up upward, whereby the flush water in the storage tank 210 is drained into the flush toilet main body 2 and is spouted from the jet spout port 2*b* provided in the lower portion of the bowl 2*a* (FIG. 2).

On the other hand, the flush water supplied from the waterworks C to a water supply pipe 232 flows into a water supply pipe branching portion 233 serving as the branching portion, via a stop cock 232*a* and a fixed flow valve 232*b*. The water supply pipe branching portion 233 splits flush water supplied from the waterworks C into a first branched pipe 233*a* serving as the first branched flow path and a second branched pipe 233*b* serving as the second branched flow path. In addition, the spout control valve 219 is provided in the first branched pipe 233*a*, and the water supply control valve 218 is provided in the second branched pipe 233*b*. Note that the stop cock 232*a* is placed outside the storage tank 210, and, on the downstream side thereof, is connected to the fixed flow valve 232*b* in the storage tank 210, and the water supply pipe branching portion 233 is provided on the downstream side of the fixed flow valve 232*b*.

The stop cock 232*a* is provided to stop the water supply to the flush water tank device 204 at the time of maintenance or the like, and is normally used in an open state. The fixed flow valve 232*b* is provided to cause the water supplied from the waterworks C to flow into the water supply pipe branching portion 233 at a predetermined flow rate, and is configured to supply the water to the flush water tank device 204 at a constant flow rate regardless of placement environment of the flush toilet device.

On the other hand, the spout control valve 219 provided in the first branched pipe 233*a* is configured to cause the water supplied from the first branched pipe 233*a* to flow out to the rim water supply pipe 225. The rim water supply pipe 225 communicates with the rim spout port 2*d* (FIG. 2) of the flush toilet main body 2 (not illustrated in FIG. 7), and spouts, from the rim spout port 2*d*, the flush water that has flowed into the rim water supply pipe 225, as rim flush water for washing the bowl. A vacuum breaker 230*b* is provided in the middle of the rim water supply pipe 225. This can prevent the water from flowing backward from a side of the flush toilet main body to the spout control valve 219 when the spout control valve 219 side is brought into a negative pressure.

The spout control valve 219 includes a spout valve main body 119*a*, a main valve body 219*b* placed in the spout valve main body 219*a*, and an electromagnetic valve pilot valve

219*c*. An electromagnetic valve 220*b* for spout control is connected to the spout control valve 219 so that the electromagnetic valve pilot valve 219*c* is moved by the electromagnetic valve 220*b* for spout control. That is, the electromagnetic valve pilot valve 219*c* is configured to open and close a pilot valve port (not illustrated) provided in the spout valve main body 219*a*. When the pilot valve port (not illustrated) is opened, the pressure inside a pressure chamber provided in the spout valve main body 219*a* decreases, and the main valve body 219*b* of the spout, control valve 219 is opened. In addition, when the pilot valve port (not illustrated) is closed, the pressure inside the pressure chamber increases, and the main valve body 219*b* is closed. Accordingly, the main valve body 219*b* of the spout control valve 219 is opened and closed in response to the operation of the electromagnetic valve 220*b* for spout control to thereby control supply and stop of the water to the rim spout port 2*d* (FIG. 2).

Next, the water supply control valve 218 provided in the second branched pipe 233*b* is configured to cause the water supplied from the second branched pipe 233*b* to flow out to the tank water supply pipe 223. The tank water supply pipe 223 is configured to supply the flush water into the storage tank 210, and the flush water that has flowed into the tank water supply pipe 223 is drained into and stored in the storage tank 210. A vacuum breaker 230*a* is provided in the middle of the tank water supply pipe 223. This can prevent the water from flowing backward from a side of the storage tank 210 to the water supply control valve 218 when the water supply control valve 218 side is brought into a negative pressure.

The water supply control valve 218 includes a control valve main body 218*a*, a main valve body 218*b* placed in the control valve main body 218*a*, and an electromagnetic valve pilot valve 218*c*. Furthermore, an electromagnetic valve 220*a* for water supply control is connected to the water supply control valve 218.

The electromagnetic valve 220*a* for water supply control is configured to move the electromagnetic valve pilot valve 218*c* incorporated in the water supply control valve 218 to open and close a pilot valve port (not illustrated) on the basis of a signal transmitted from the controller 228. When the pilot valve port (not illustrated) is opened, the pressure inside a pressure chamber provided in the control valve main body 218*a* decreases, and the main valve body 218*b* of the water supply control valve 218 is opened. In addition, when the pilot valve port (not illustrated) is closed, the pressure inside the pressure chamber increases, and the main valve body 218*b* is closed. Accordingly, the main valve body 218*b* of the water supply control valve 218 is opened and closed in response to the operation of the electromagnetic valve 220*a* for water supply control to thereby control supply and stop of the water into the storage tank 210. Note that in the present embodiment, as the electromagnetic valve 220*a* for water supply control, there is used a bistable latching solenoid that moves the electromagnetic valve pilot valve 218*c* when the energization is performed once, and maintains this state even when the energization is stopped. This type of electromagnetic valve can return the electromagnetic valve pilot valve 218*c* to an original position when the energization is performed again in the opposite direction.

Specifically, the controller 228 receives a signal from a lever handle 208, and transmits an electric signal to the electromagnetic valve 220*a* for water supply control, to actuate the electromagnetic valve 220*a* for water supply control, which causes the water supply control valve 218 to be opened. The water supply control valve 218 controls supply and stop of the supplied flush water into the storage tank 210 on the basis of an instruction signal from the controller 228 serving as the controller.

A vacuum breaker 230*a* is provided in the tank water supply pipe 223 connected to the water supply control valve 218. If the water supply control valve 218 side is brought into a negative pressure by this vacuum breaker 230*a*, outside air is drawn into the tank water supply pipe 223, which can prevent the water from flowing backward from the storage tank 210 side.

Next, the discharge valve operation device 214 is configured to be capable of lifting the discharge valve 212 upward on the basis of a control signal from the controller 228, which enables the discharge valve 212 to be opened and closed. Specifically, the discharge valve operation device 214 includes a motor, a pulley (none of the above is illustrated) attached to the motor, and a wire 215 to be wound up on the pulley. A lower end of the wire 215 is connected to the discharge valve 212, and the motor of the discharge valve operation device 214 is actuated, which enables discharge valve 212 to be raised and lowered.

The controller 228 incorporates a circuit board therein, and is configured to control the electromagnetic valve 220*a* for water supply control, the electromagnetic valve 220*b* for spout control, the discharge valve operation device 214, and the like in response to the operation of the lever handle 208. A microprocessor, a memory, an interface circuit, and the like are provided on the circuit board, and these are operated by software for controlling the toilet flush.

Next, an operation of the flush toilet device according to the third embodiment of the present invention will be described with reference to FIG. 8.

Figure 8:
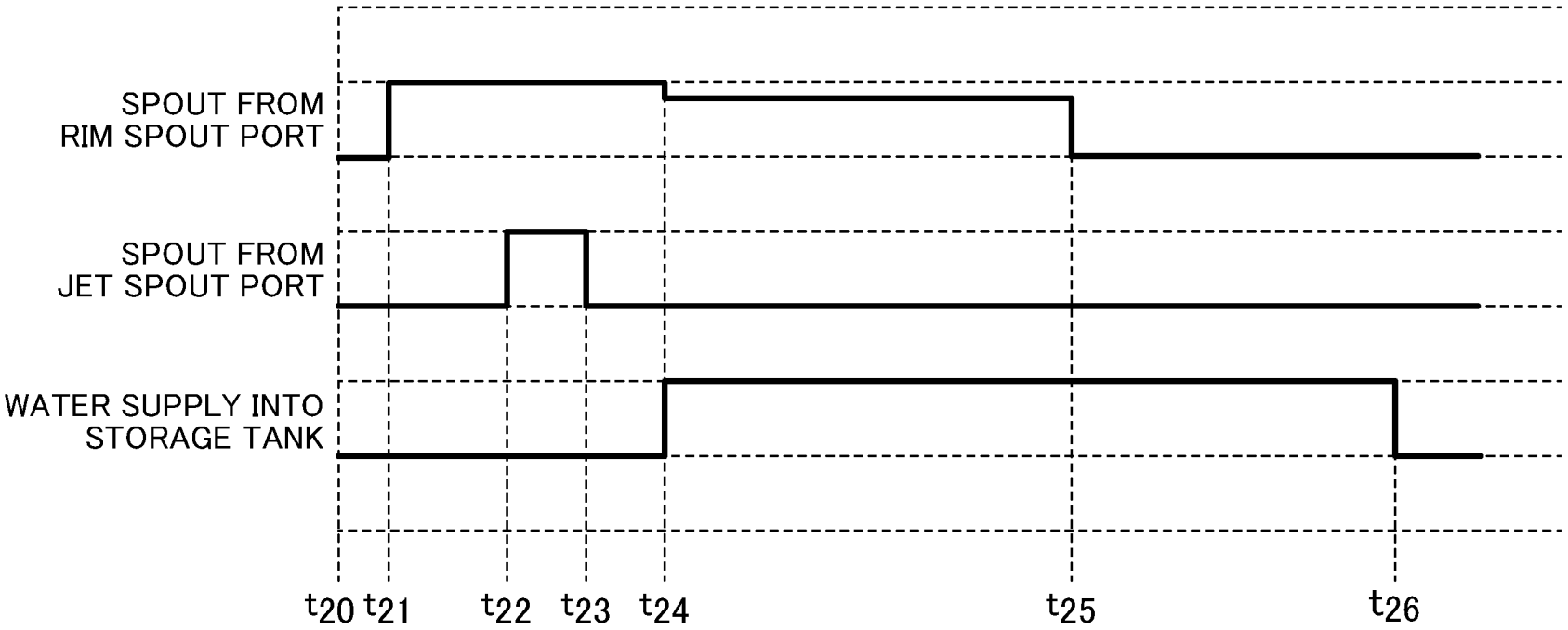
FIG. 8 is a time chart illustrating an example of toilet flush sequence by the flush toilet device of the third embodiment of the present invention.

FIG. 8 is a time chart illustrating an example of toilet flush sequence by the flush toilet device of the third embodiment of the present invention, in which the upper sequence represents a spout flow rate from the rim spout port, the middle sequence represents a spout flow rate from the jet spout port, and the lower sequence represents a water supply flow rate to the storage tank.

First, in a wait state of the toilet flush at time $t_{20}$ in FIG. 8, a water level in the storage tank 210 is a stopped water level $L_1$, and no energization is performed to the electromagnetic valve 220*a* for water supply control and the electromagnetic valve 220*b* for spout control. In this state, both of the pilot valve port (not illustrated) to be opened and closed by the electromagnetic valve pilot valve 219*c* and the pilot valve port (not illustrated) to be opened and closed by the electromagnetic valve pilot valve 218*c* are closed. This brings the main valve body 218*b* of the water supply control valve 218 and the main valve body 219*b* of the spout control valve 219 into a valve closed state.

Next, when the user operates the lever handle 208 at time $t_{21}$ in FIG. 8, a signal instructing a toilet flush is transmitted to the controller 228 (FIG. 7). When receiving the instruction signal for a toilet flush, the controller 228 performs the energization to the electromagnetic valve 220*b* for spout control to open the electromagnetic valve pilot valve 219*c* of the spout control valve 219. This causes the pressure inside the pressure chamber of the spout control valve 219 to be decreased, whereby the main valve body 219*b* is detached from a valve seat and is opened. Note that in the present embodiment, since a bistable latching solenoid is used as the electromagnetic valve 220*b* for spout control, once the electromagnetic valve pilot valve 219*c* is opened, the valve open state is maintained even when the energization is stopped.

When the spout control valve 219 is opened, tap water supplied from the water supply pipe 232 to the spout control valve 219 via the water supply pipe branching portion 233 and the first branched pipe 233*a* flows into the rim water supply pipe 225 through the spout control valve 219. The flush water that has flowed into the rim water supply pipe 225 is spouted from the rim spout port 2*d* (FIG. 2) of the flush toilet main body. The flush water that has been spouted from the rim spout port 2*d* flows downward while swirling in the bowl 2*a* and washes a waste receiving surface of the bowl 2*a*. The water spout from the rim spout port 2*d* is performed as "pre-rim" spout to be performed before the water spout from the jet spout port 2*b* is started.

At time $t_{22}$ after a lapse of a predetermined time from when the energization is performed to the electromagnetic valve 220*b* for spout control, the controller 228 transmits a control signal to the discharge valve operation device 214, lifts the discharge valve 212 upward via the wire 215, and causes the discharge port 210*a* to be opened. Hereby the flush water stored in the storage tank 210 flows out through the discharge port 210*a*, and is spouted, as "jet spout water," from the jet spout port 2*b* (FIG. 2) provided in the lower portion of the bowl 2*a*.

The flush water spouted from the jet spout port 2*b* fills the discharge trap conduit 2*e* extending from the lower portion of the bowl 2*a* and induces a siphon phenomenon. By the siphon phenomenon, pooled water and waste in the bowl 2*a* are drained through the discharge trap conduit 2*e*. In this way, the water spout from the rim spout port 2*d* is continued as "mid-rim" spout even while the flush water is being spouted from the jet spout port 2*b*. Therefore, when the discharge port 210*a* is opened, the flush water is spouted from both of the rim spout port 2*d* and the jet spout port 2*b* at a time.

In this way in the flush toilet device of the present embodiment, the supply of the flush water from the rim spout port 2*d* is continued even while the siphon phenomenon is occurring due to the flush water drained from the jet spout port 2*b*. Therefore, the pooled water is drawn by the siphon phenomenon, whereby the pooled water in the bowl 2*a* excessively decreases, which makes it possible to suppress a shortage of sealing water in the discharge trap conduit 2*e*. When a shortage of sealing water in the discharge trap conduit 2*e* occurs, an odor may flow backward from the discharge trap conduit 2*e*, but in the present embodiment, this can be suppressed. Since the supply of the flush water from the rim spout port 2*d* is continued even while the siphon phenomenon is occurring, the siphon phenomenon can be continued without shortage of the sealing water, and the siphon phenomenon can be prevented from terminating halfway.

At time $t_{23}$ after a lapse of a predetermined time from when the discharge port 210*a* is opened, the controller 228 transmits a control signal to the discharge valve operation device 214, and lowers the discharge valve 212 so that the discharge valve 212 is seated on the discharge port 210*a*. Hereby, the water discharge from storage tank 210 is stopped, and the spout of the flush water from the jet spout port 2*b* (FIG. 2) is stopped.

Furthermore, at time $t_{24}$ after a lapse of a predetermined time from when the discharge port 210*a* is closed, the controller 228 performs the energization to the electromagnetic valve 220*a* for water supply control, and detaches the electromagnetic valve pilot valve 218*c* from the pilot valve port (not illustrated). This causes the pressure inside the pressure chamber of the water supply control valve 218 to be decreased, whereby the main valve body 218*b* is detached from a valve seat and is opened. That is, the controller 22$ causes the water supply control valve 218 to be opened while maintaining the valve open state of the spout control valve 219 after the spout control valve 219 is opened. Note that in the present embodiment, since a bistable latching solenoid is used as the electromagnetic valve 220*a* for water supply control, once the electromagnetic valve pilot valve 218*c* is opened, the valve open state is maintained even when the energization is stopped.

When the water supply control valve 218 is opened, tap water supplied from the water supply pipe 232 to the water supply control valve 218 via the water supply pipe branching portion 233 and the second branched pipe 233*b* flows into the storage tank 210 through the water supply control valve 218. That is, the controller 228 causes the water supply control valve 218 to be opened while maintaining the valve open state of the spout control valve 219 after the spout control valve 219 is opened.

Accordingly, after $t_{24}$ in FIG. 8, the water spout from the rim spout port 2*d* and the water supply into the storage tank 210 are performed at a time. Here, the flow rate of tap water flowing in the water supply pipe 232 is maintained substantially at constant by the fixed flow valve 232*b*. Therefore, when the water supply control valve 218 is further opened in the state in which the spout control valve 219 is open, the flow rate of the water flowing into the spout control valve 219 decreases, and the flow rate of the flush water spouted from the rim spout port 2*d* decreases when the water supply control valve 218 is opened. However, the flush water to be spouted from the rim spout port 2*d* can be used to suppress the interruption of siphon phenomenon occurring in the discharge trap conduit 2*e* (FIG. 2). In addition, the water spout from the rim spout port 2*d* is continued as "post-rim" spout to be performed after the termination of the jet spout, and the flush water spouted from the rim spout port 2*d* flows into the bowl 2*a*, and is used as refill water.

Furthermore, at time $t_{25}$ after a lapse of a predetermined time from when the water supply control valve 218 is opened at time $t_{24}$, the controller 228 transmits a control signal to the electromagnetic valve 220*b* for spout control to cause the electromagnetic valve pilot valve 219*c* to be closed. Hereby, the spout control valve 219 is closed, and the spout of the flush water from the rim spout port 2*d* is stopped.

Furthermore, since the water supply control valve 218 is open even after the water spout from the rim spout port 2*d* is stopped, the water supplied from the water supply pipe 232 flows into the storage tank 210, and the water level in the storage tank 210 rises. The water level in the storage tank 210 rises to a predetermined stopped water level $L_1$ at the time $t_{26}$ after a lapse of a predetermined time from when the water supply into the storage tank 210 is started at time $t_{24}$. The controller 228 transmits a control signal to the electromagnetic valve 220*a* for water supply control, to cause the electromagnetic valve pilot valve 218*c* to be closed. Hereby, the pressure inside the pressure chamber in the control valve main body 218*a* is increased to close the main valve body 218*b*, whereby the water supply control valve 218 is brought into the valve closed state. Accordingly, the water supply into the storage tank 210 is stopped, and one toilet flush is completed.

According to the flush toilet device of the third embodiment of the present invention, the discharge valve 212 is driven by the discharge valve operation device 214, and therefore the flush water can be spouted from the jet spout port 2*b* independently of the supply of the flush water into the storage tank 210, and the flush water can be used efficiently to perform the toilet flush.

The embodiments of the present invention have been described above, but various changes may be added to the above-described embodiments. In particular, in the above-described embodiments, the rim spout port serving as the upper spout port is provided above the pooled water surface, and the jet spout port serving as the lower spout port is provided below the pooled water surface, but positions of these spout ports may be appropriately changed above and below the pooled water surface. The present invention can be constituted by optionally combining the above-described optional structural elements included in each embodiment of the present invention with configurations of the other embodiments.

REFERENCE SIGNS LIST

1 Flush toilet device
2 Flush toilet main body
2*a* Bowl
2*b* Jet spout port (lower spout port)
2*c* Rim
2*d* Rim spout port (upper spout port)
2*e* Discharge trap conduit
4 Flush water tank device
8 Lever handle
10 Storage tank (flush water tank main body)
10*a* Discharge port
10*b* Overflow pipe
12 Discharge valve
14 Discharge valve hydraulic driving part (hydraulic driving mechanism)
14*a* Cylinder
14*b* Piston
14*c* Spring
14*d* Gap
14*e* Packing
14*f* Through hole
15 Rod
17 Water supply control valve (second on-off valve)
17*a* Water supply valve main body
17*b* Main valve body
17*c* Electromagnetic valve pilot valve
18 Discharge valve control valve
18*a* Control valve main body
18*b* Main valve body
18*c* Electromagnetic valve pilot valve
19 Spout control valve (first on-off valve)
19*a* Spout valve main body
19*b* Main valve body
19*c* Electromagnetic valve pilot valve
20*a* Electromagnetic valve for discharge control
20*b* Electromagnetic valve for spout control
20*c* Electromagnetic valve for water supply control
23 Inflow pipe
24 Outflow pipe
24*b* First descending pipe
24*c* Second descending pipe
25 Rim water supply pipe
27 Tank water supply pipe
28 Controller (controller)
30*a* Vacuum breaker
30*b* Vacuum breaker
30*c* Vacuum breaker
32 Water supply pipe
32*a* Stop cock
32*b* Fixed flow valve
33 Water supply pipe branching portion (branching portion)
33*a* First branched pipe (first branched flow path)
33*b* Second branched pipe (second branched flow path)
33*c* Third branched pipe
104 Flush water tank device
110 Flush water tank
110*a* Discharge port
110*b* Overflow pipe
112 Discharge valve
114 Discharge valve hydraulic driving part (hydraulic driving mechanism)
114*a* Cylinder
114*b* Piston
114*c* Spring
114*d* Gap
114*e* Packing
114*f* Through hole
115 Rod
115*a* Upper rod
115*b* Lower rod
118 Water supply control valve (second on-off valve)
118*a* Control valve main body
118*b* Main valve bods
118*c* Electromagnetic valve pilot valve
118*d* Float pilot valve
119 Spout control valve (first on-off valve)
119*a* Spout valve main body
119*b* Main valve body
119*c* Electromagnetic valve pilot valve
120*a* Electromagnetic valve for water supply control
120*b* Electromagnetic valve for spout control
122 Clutch mechanism
123 Inflow pipe
124 Outflow pipe
124*b* First descending pipe
124*c* Second descending pipe
125 Rim water supply pipe
126 Discharge valve float mechanism
126*a* Float portion
126*b* Engaging portion
128 Controller (controller)
130*a* Vacuum breaker
130*b* Vacuum breaker
132 Water supply pipe
132*a* Stop cock
132*b* Fixed flow valve
133 Water supply pipe branching portion (branching portion)
133*a* First branched pipe (first branched flow path)
133*b* Second branched pipe (second branched flow path)
134 Control valve float
134*a* Arm portion
204 Flush water tank device
210 Storage tank
210*a* Discharge port
212 Discharge valve
214 Discharge valve operation device
215 Wire
218 Water supply control valve (second on-off valve)
218*a* Control valve main body
218*b* Main valve body
218*c* Electromagnetic valve pilot valve
219 Spout control valve (first on-off valve)
219*a* Spout valve main body
219*b* Main valve body

219*c* Electromagnetic valve pilot valve
220*a* Electromagnetic valve for water supply control
220*b* Electromagnetic valve for spout control
223 Tank water supply pipe
225 Rim water supply pipe
228 Controller
230*a* Vacuum breaker
230*b* Vacuum breaker
232 Water supply pipe
232*a* Stop cock
232*b* Fixed flow valve
233 Water supply pipe branching portion
233*a* First branched pipe (first branched flow path)
233*b* Second branched pipe (second branched flow path)

What is claimed is:

1. A flush toilet device that supplies flush water to an upper spout port provided above a pooled water surface of a flush toilet main body and a lower spout port provided below the pooled water surface to perform a flush, the flush toilet device comprising:

a flush toilet main body that includes a bowl and a discharge trap conduit communicating with a lower portion of the bowl;

a flush water tank main body that stores flush water for washing the flush toilet main body;

a discharge valve that switches between spout and stop of the flush water from the lower spout port by switching between discharge and stop of the flush water stored in the flush water tank main body;

a branching portion that splits flush water supplied from a water supply source into a first branched flow path and a second branched flow path;

a first on-off valve that is provided in the first branched flow path and switches between a spouting state and a spouting stop state of the flush water from the upper spout port;

a second on-off valve that is provided in the second branched flow path and switches between supply and stop of the flush water into the flush water tank main body; and a controller that controls the first on-off valve and the second on-off valve so that water is spouted from the upper spout port and is supplied into the flush water tank main body at a same time by opening the first on-off valve and the second on-off valve;

wherein the second on-off valve is opened in a state where the first on-off valve is open and the water is spouting from the upper spout port, and a flow rate of the flush water spouting from the upper spout port is lowered when the second on-off valve is opened.

2. The flush toilet device according to claim 1, wherein the controller causes the second on-off valve to be opened while the first on-off valve is maintained in the valve open state after the first on-off valve is opened.

3. The flush toilet device according to claim 2, further comprising:

a hydraulic driving mechanism that drives the discharge valve using a water supply pressure of the flush water supplied from the water supply source, wherein the hydraulic driving mechanism drives the discharge valve by supplying the flush water that has flowed out of the second on-off valve to the hydraulic driving mechanism.

4. The flush toilet device according to claim 3, wherein at least a part of the flush water supplied to the hydraulic driving mechanism flows into the flush water tank main body after the flush water actuates the hydraulic driving mechanism.

5. The flush toilet device according to claim 3, wherein a part of the flush water that has flowed out of the hydraulic driving mechanism flows into the flush water tank main body, and the remainder of the flush water bypasses the discharge valve to flow into the flush toilet main body from the lower spout port.

6. The flush toilet device according to claim 1, wherein after any one of the first on-off valve and the second on-off valve is closed, the other valve is maintained in a valve open state for a predetermined time period, and refill water is supplied to the flush toilet main body.

* * * * *